US007383644B2

(12) United States Patent
Lyu et al.

(10) Patent No.: US 7,383,644 B2
(45) Date of Patent: Jun. 10, 2008

(54) APPARATUS CONTROLLING WASHING/DRYING SYSTEM WIRELESSLY

(75) Inventors: Jae Cheol Lyu, Changwon-si (KR); Seong Jin Jo, Changwon-si (KR); Deug Hee Lee, Kyungsangnam-do (KR); Kwon Ki Hong, Changwon-si (KR); Byung Hwan Ahn, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 44 days.

(21) Appl. No.: 11/450,398

(22) Filed: Jun. 12, 2006

(65) Prior Publication Data

US 2006/0225301 A1 Oct. 12, 2006

Related U.S. Application Data

(62) Division of application No. 11/019,362, filed on Dec. 23, 2004, now Pat. No. 7,096,601.

(30) Foreign Application Priority Data

Dec. 26, 2003 (KR) ..... 2003-97829
Dec. 26, 2003 (KR) ..... 2003-97831
Dec. 26, 2003 (KR) ..... 2003-97832
Dec. 26, 2003 (KR) ..... 2003-97834
Dec. 26, 2003 (KR) ..... 2003-97835

(51) Int. Cl.
*F26B 11/02* (2006.01)

(52) U.S. Cl. ..... 34/596

(58) Field of Classification Search ..... 34/601, 34/596; 134/42 R; 68/3 R; 706/1
See application file for complete search history.

(56) References Cited

U.S. PATENT DOCUMENTS

| | | | | |
|---|---|---|---|---|
| 4,454,732 | A | 6/1984 | Burkland et al. | |
| 4,797,656 | A | 1/1989 | Keppler | |
| 5,089,809 | A * | 2/1992 | Carmichael, Jr. | 340/679 |
| 5,680,445 | A * | 10/1997 | Bogner et al. | 379/106.01 |
| 6,157,313 | A * | 12/2000 | Emmermann | 340/5.42 |
| 6,424,252 | B1 | 7/2002 | Adler | |
| 6,626,013 | B2 | 9/2003 | Ohta et al. | |
| 6,850,149 | B2 * | 2/2005 | Park | 340/7.1 |

FOREIGN PATENT DOCUMENTS

| | | |
|---|---|---|
| DE | 196 15 358 A1 | 11/1996 |
| DE | 198 02 650 A1 | 7/1999 |
| EP | 1 433 894 A1 | 6/2004 |
| JP | 05-023475 A | 2/1993 |
| JP | 05-293293 A | 11/1993 |
| JP | 10-201984 A | 8/1998 |
| JP | 2003-71178 A | 3/2003 |
| JP | 2003-265886 A | 9/2003 |

* cited by examiner

*Primary Examiner*—S. Gravini
(74) *Attorney, Agent, or Firm*—Birch, Stewart, Kolasch & Birch, LLP

(57) ABSTRACT

Provided is an apparatus and method for controlling a washing/drying system including a washing machine and a dryer used in one pair. Since the washing machine can communicate with the dryer according to a wireless communication regulation, the dryer can operate more conveniently. According to the apparatus and method, convenience in using the washing machine and the dryer together is further enhanced.

2 Claims, 17 Drawing Sheets

APPARATUS CONTROLLING WASHING/DRYING SYSTEM WIRELESSLY

CROSS REFERENCE TO RELATED APPLICATION

This application is a Divisional Application of application Ser. No. 11/019,362 filed on Dec. 23, 2004 now U.S. Pat. No. 7,096,601, entitled "APPARATUS AND METHOD FOR CONTROLLING WASHING/DRYING SYSTEM", which claims priority from Korean Application No. 10-2003-0097829 filed in Korea on Dec. 26, 2003, Korean Application No. 10-2003-0097831 filed in Korea on Dec. 26, 2003, Korean Application No. 10-2003-0097832 filed in Korea on Dec. 26, 2003, Korean Application No. 10-2003-0097834 filed in Korea on Dec. 26, 2003 and Korean Application No. 10-2003-0097835 filed in Korea on Dec. 26, 2003. The entire contents of each application are hereby incorporated by reference.

BACKGROUND OF THE INVENTION

1. Field of the Invention

The present invention relates to apparatus and method for controlling a washing/drying system, and more particularly, to apparatus and method for controlling a washing/drying system in which a dryer operates based on washing information performed in a washing machine. Further, the present invention relates to apparatus and method for controlling a washing/drying system in which when a washing machine and a dryer are adjacent to each other and are independently used, operation information used in operating the washing machine is used in operating the dryer, thereby more conveniently and simply manipulating and operating the dryer.

2. Description of the Related Art

A washing machine washes laundry received in a drum using rotation of the drum. The pulsator type washing machine, the agitator type washing machine, the drum type washing machine and the like have been well known to those skilled in the art. A dryer is used to completely remove moisture remaining in laundry that the dewatering cycle is completed, using hot air.

In detail, the dryer blows hot air generated by a heater into the drum to absorb moisture from laundry to be dried. The dryer can be classified into an exhaust type dryer and a condensed type dryer. The exhaust type dryer exhausts wet air discharged from the drum to an outside of the dryer, and the condensed type dryer condenses wet air discharged from the drum at a condenser to remove moisture from the wet air and convert the wet air into dry air and again blows the dry air to the drum to recycle the air.

Meanwhile, the conventional washing and drying cycles are continuously performed in once washing operation. In other words, laundry washed in the washing machine is directly received in the dryer to perform drying. Thus, to continuously perform the washing and the drying, the washing machine and the dryer are disposed adjacent to each other. In addition, information acquired or inputted while the washing machine operates is transmitted to the dyer through wiring communication to allow a user to operate the dryer more conveniently, which is well known to those skilled in the art.

However, the wiring communication causes many inconveniences for a user. For instance, the user has to connect a wiring cable and a separate space for installation of the cable is required. Also, displacement of the washing machine and the dryer is allowable only after the cable is separated, which makes inconvenient users.

Recently, as the inner space is getting narrow and narrow, the washing machine and the dryer are frequently used in stack structure. In such a stack structure, it is general that the washing machine having heavy weight due to use of much amount of water is disposed above the dryer having light weight.

However, when the washing machine and the dryer are used in the stack structure, a user feels inconvenience because the user's hand does not reach a manipulation panel disposed at an upper side of the dryer. Also, it can be considered that the manipulation panel is disposed at a lower portion of the dryer for the convenience of use, which makes convenient the user in the stack structure but makes inconvenient the user in a parallel structure where the washing machine and the dryer are disposed in parallel.

SUMMARY OF THE INVENTION

Accordingly, the present invention is directed to apparatus and method for controlling a washing/drying system that substantially obviates one or more problems due to limitations and disadvantages of the related art.

An object of the present invention is to provide apparatus and method for controlling a washing/drying system that enables a user to control the washing/drying system more conveniently.

Another object of the present invention is to provide apparatus and method for controlling a washing/drying system that enables a user to displace a washing machine and a dryer by only performing displacement of the washing machine and the dryer without an additional cable separation operation.

A further object of the present invention is to provide apparatus and method for controlling a washing/drying system that enables a user to manipulate a dryer disposed on a washing machine more conveniently when the dryer and the washing machine are used in a stack structure.

Still another object of the present invention is to provide apparatus and method for controlling a washing/drying system that enables a user to use a washing machine and a dryer more conveniently when the washing machine and the dryer are disposed in parallel.

Resultantly, the present invention provides apparatus and method for controlling a washing/drying system where a washing machine and a dryer are combined that can maximize convenience of manipulation.

Additional advantages, objects, and features of the invention will be set forth in part in the description which follows and in part will become apparent to those having ordinary skill in the art upon examination of the following or may be learned from practice of the invention. The objective and other advantages of the invention may be realized and attained by the structure particularly pointed out in the written description and claims hereof as well as the appended drawings.

To achieve these objective and other advantages and in accordance with the purpose of the invention, as embodied and broadly described herein, there is provided an apparatus for controlling a washing/drying system, the apparatus comprising: a washing machine for performing washing of laundry; a wireless washing machine communication part for processing washing information of the washing machine in a wireless communication regulation; a washing machine antenna through which the washing information processed in the wireless communication regulation is transmitted; and a dryer for wirelessly receiving the washing information transmitted through the washing machine antenna and drying the laundry based on the received laundry information, wherein the washing machine and the dryer are separatable and usable independently.

In another aspect of the present invention, there is provided an apparatus for controlling a washing/drying system, the apparatus comprising: a washing machine for performing washing of laundry, the washing machine including a sensor for sensing information related with the laundry during the washing; a washing machine manipulator for manipulating operation of the washing machine, a wireless washing machine communication part and an antenna for processing washing information of the washing machine and wirelessly transmitting operation of the washing machine manipulator; a dryer including a dyer antenna and a wireless dryer communication part for wirelessly receiving the washing information transmitted through the washing machine antenna; and a dryer manipulator for manipulating an operation of the dryer at a user.

In another aspect of the present invention, there is provided an apparatus for controlling a washing/drying system, the apparatus comprising: a washing machine for performing washing of laundry; a dryer for drying the laundry washed in the washing machine; a dryer manipulator which is separatable from a main body of the dryer; and a receiving part formed at a predetermined portion of the dryer and/or the washing machine, for receiving the dryer manipulator therein.

In another aspect of the present invention, there is provided an apparatus for controlling a washing/drying system, the apparatus comprising: a washing machine into which at least operation condition of a dryer is inputted through a remote controller and/or a washing machine manipulator; two or more user interfaces disposed inside the washing machine, for independently processing the operation condition of the dryer and operation condition of the washing machine; and the dryer disposed independently from the washing machine, for wirelessly receiving control information of the dryer to dry laundry.

In another aspect of the present invention, there is provided an apparatus for controlling a washing/drying system, the apparatus comprising: a washing machine for performing washing of laundry; a dryer stacked on the washing machine, for drying the laundry washed in the washing machine; a washing machine communication part for transmitting a control information of the washing machine to the dryer; a remote controller communication part installed at the dryer, for transmitting the control information of the washing machine; and a remote controller for displaying information transmitted from the remote controller communication part and selecting a control information of the dryer from the control information of the washing machine to transmitting the selected control information of the dryer to the dryer.

In another aspect of the present invention, there is provided an apparatus for controlling a washing/drying system, the apparatus comprising: a washing machine having a first remote controller communication part for reading out a control information of the washing machine from a memory and transmitting the read control information to a dryer; a remote controller for receiving a signal transmitted from the first remote controller communication part and designating a control information of the dryer; and the dryer having a second remote controller communication part for receiving the control information of the dryer transmitted from the remote controller.

In another aspect of the present invention, there is provided an apparatus for controlling a washing/drying system, the apparatus comprising: a washing machine for performing washing of laundry; a dryer for drying the laundry; and a communication part for wirelessly transmitting and receiving operation information of the washing machine and/or operation information of the dryer.

In another aspect of the present invention, there is provided a method for controlling a washing/drying system, the method comprising the steps of: performing an operation of a washing machine; wirelessly transmitting operation information of the washing machine; determining operation condition of a dryer based on the operation information of the washing machine wirelessly received; and performing an operation of the dryer based on the operation condition of the dryer.

According to the proposed apparatus and method for controlling the washing/drying system, user convenience is enhanced and the washing machine and the dryer can be prevented from being damaged during displacement of the washing machine and the dryer.

Also, when the washing machine and the dryer are disposed in a stack structure, it is possible to conveniently manipulate the washing machine or the dryer disposed at an upper side.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
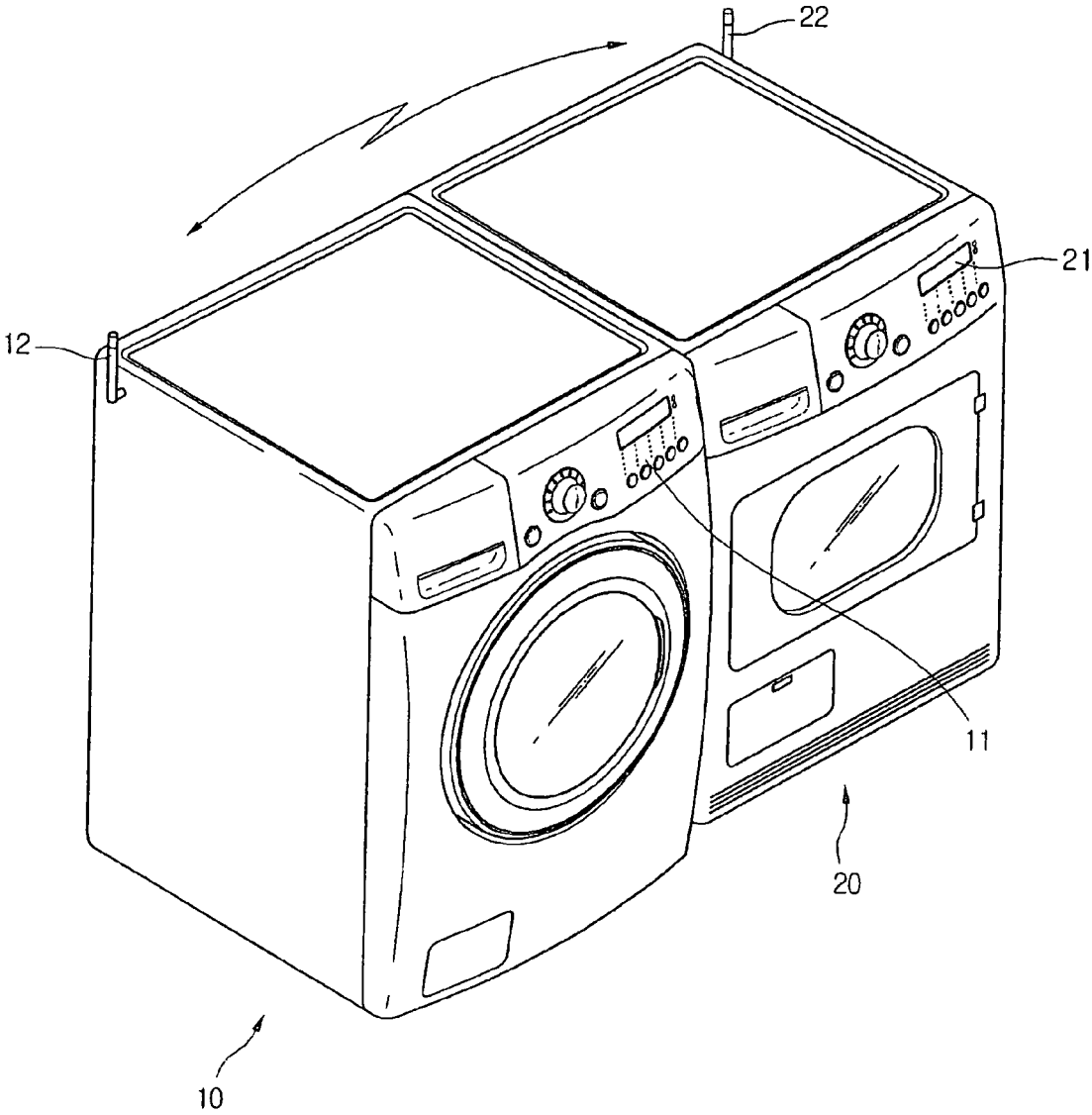
FIG. 1 is a perspective view of a washing/drying system employing a control system according to a first embodiment of the present invention.

FIG. 1 is a perspective view of a washing/drying system employing a control system according to a first embodiment of the present invention.

Referring to FIG. 1, the washing/drying system includes a washing machine 10, a manipulation panel 11 formed at a predetermined portion of the washing machine 10, for inputting instructions such as kinds of laundry, washing method and the like, and a washing machine antenna 12 formed at a predetermined portion of the washing machine 10.

The washing machine 10 can include all kinds of washing machines irregardless of the kinds of the washing machines. The washing machine antenna 12 is preferably formed at an invisible rear side of the washing machine 10. However, the installation site of the washing machine antenna 12 is not limited to the aforementioned invisible rear side.

Meanwhile, the dryer 20 includes a manipulation panel 21 formed at a predetermined portion of the dryer 20 and manipulated by a user, and a second antenna 22 formed at a predetermined portion of the dryer 20.

The washing machine antenna 12 transmits laundry-related information instructed by a user or known during the operation of the washing machine, to the dryer antenna 22. Also, the dryer antenna 22 receives information transmitted through the washing machine antenna 12. Accordingly, if necessary, the washing machine manipulator 11 operates as the dryer manipulator 21 such that operation information of the dryer is inputted by the washing machine manipulator 11 and is then wirelessly transmitted to the dryer manipulator 21.

All kinds of communication regulations including an infrared communication regulation, a supersonic communication regulation, a radio frequency (RF) communication regulation, and a Bluetooth communication regulation can be allowed for wireless communication between the washing machine antenna 12 and the dryer antenna 22.

Figure 2:
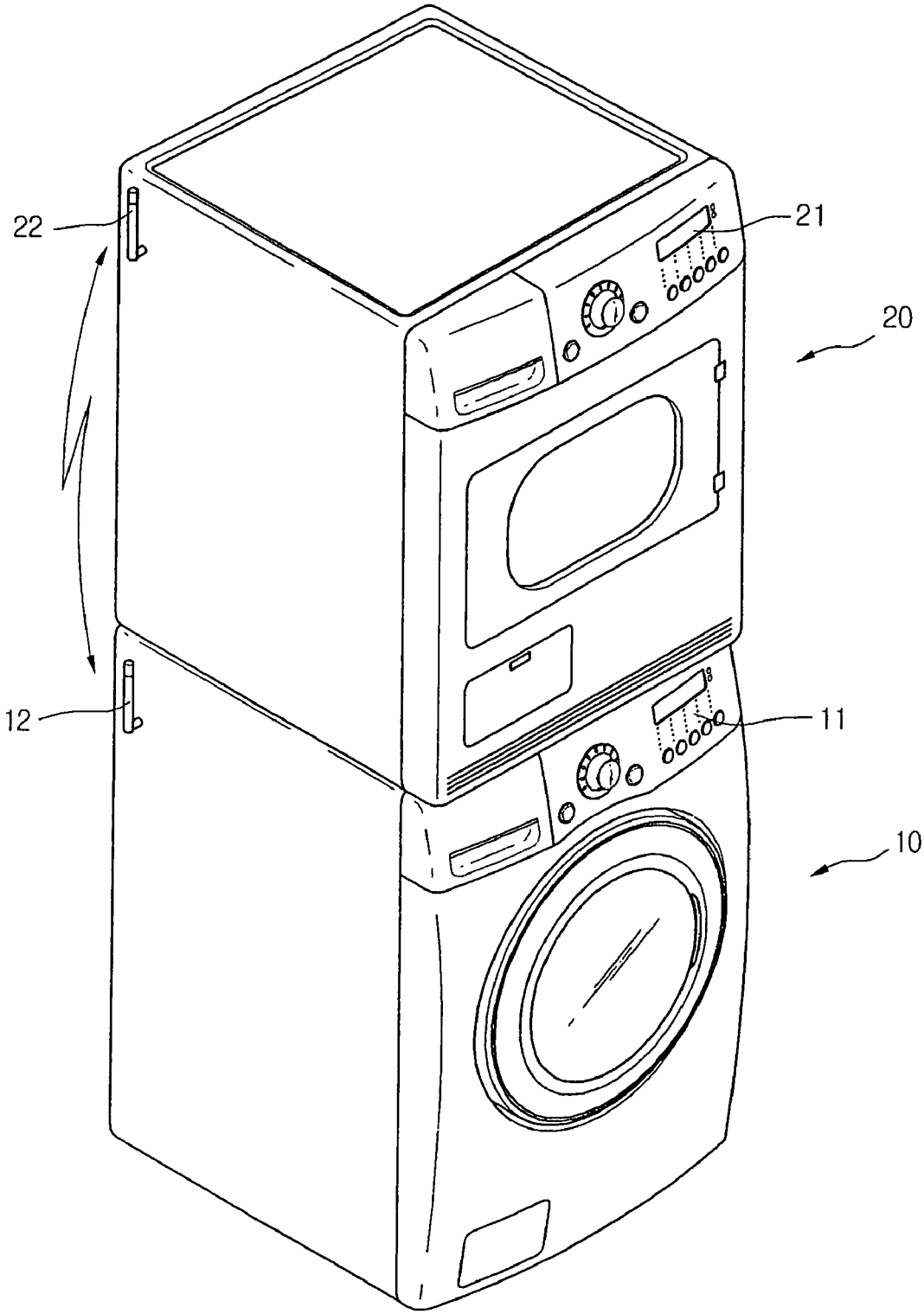
FIG. 2 is a perspective view illustrating that a washing machine and a dryer are used in a stack structure according to the first embodiment of the present invention.

FIG. 2 is a perspective view illustrating that a washing machine and a dryer are used in a stack structure according to the first embodiment of the present invention.

Referring to FIG. 2, the dryer 20 is disposed on the washing machine 10. Like in FIG. 1, the washing machine manipulator 11 for instructing kinds of laundries, washing methods and the like at the user is formed at a front upper side of the washing machine 10 and the dryer manipulator 21 manipulated by the user is formed at a front upper side of the dryer 20.

As will be seen from FIGS. 1 and 2, the washing machine 10 and the dryer 20 are disposed in parallel in a horizontal direction or in a stack structure. However, since the washing machine and the dryer operate in a wireless communication, the arrangement of the washing machine and the dryer does not influence a control of the washing machine and the dryer.

Figure 3:
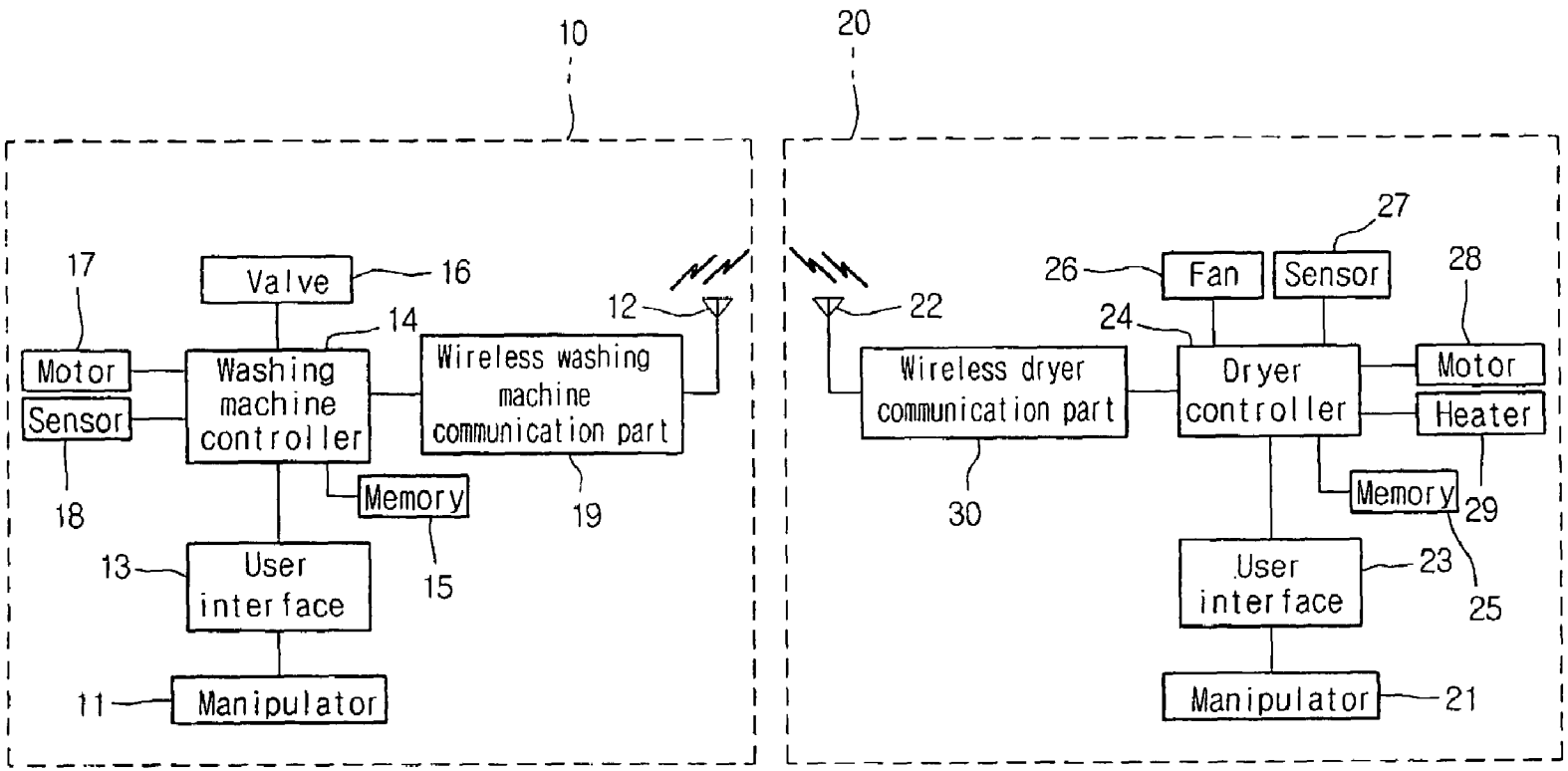
FIG. 3 is a block diagram of an apparatus for controlling a washing/drying system according to the first embodiment of the present invention.

FIG. 3 is a block diagram of an apparatus for controlling a washing/drying system according to the first embodiment of the present invention.

Referring to FIG. 3, the washing machine 10 includes a washing machine manipulator 11 for inputting a manipulation signal to the washing machine 10 at a user, a user interface 13 for determining the manipulation signal inputted through the washing machine manipulator 11, and a washing machine controller 14 for determining the manipulation signal inputted through the user interface 13 to control the washing machine 10 such that the washing machine 10 operates in a proper condition.

Also, the washing machine 10 further includes load elements controlled by the washing machine controller 14, i.e., a motor 17 for rotating a drum of the washing machine, a valve 16 for adjusting supply of water and detergent to the washing machine, and a sensor for sensing information related with washing water and laundry. The washing machine 10 also includes a memory 15 for storing washing-related information including the information related with the washing water and laundry sensed by the sensor 18 and information inputted through the washing machine manipulator 11 at the user.

In addition, the washing machines further includes a wireless washing machine communication part 19, which converts the washing information stored in the memory 15 into a signal adapted for a wireless communication regulation such that the washing information can be transmitted to the dryer 20. Of course, the information of the wireless washing communication part 19 is transmitted to the dryer 20 through the washing machine antenna 12.

Meanwhile, the dryer 20 includes a dryer antenna 22 for wirelessly receiving information wirelessly transmitted through the washing machine antenna 12, and a wireless dryer communication part for converting the information received through the dryer antenna 22 into information necessary for the operation of the dryer 20. In addition, the dryer 20 includes a manipulator 21 for inputting a manipulation signal instructed by the user for the operation of the dryer, a user interface 23 for inputting the manipulation signal of the manipulator 21 to a dryer controller 24, and a memory 25 for storing information related with the operation of the dryer 20.

Also, the dryer 20 further includes load elements controlled by the dryer controller 24, i.e., a motor 28, a heater 29 and a fan 26. Specifically, the motor 28 rotates a drum so as to uniformly dry the laundry, the fan 26 forcibly blows outer air to an inside of the dryer such that the blown air flows, and the heater 29 heats the air blown to the inside of the dryer 20 up to a proper temperature such that the laundry is more rapidly dried.

A method for controlling the aforementioned washing/drying system will now be described in brief.

When the user intends to use the washing machine, laundry is loaded into the inside of the washing machine and the user inputs known facts related with the laundry. The input information can include various types, for example, information related with the kinds of laundry (nylon, cotton, wool and the like), information regarding supply amount of detergent, and information related with operation time of the washing machine. The informations can be inputted by the user's determination.

The information inputted by the user is used to operate the washing machine as soon as the user operates the washing machine. As the washing machine operates, the washing machine can sense information related the laundry during an initial operation, for example, weight, volume and the like of the laundry, and the sensed information can be also used for the operation of the washing machine.

Base on the information related with the kinds of laundry, the information related with supply amount of detergent, and the information related with operation time of the washing machine, the washing machine performs washing, rinsing and dewatering cycles. As the operation of the washing machine is ended, the user loads the washed laundry into the dryer 20 and operates the dryer 20. Before the laundry is loaded into the dryer and the dryer operates, the step of wirelessly transmitting the information stored in the washing machine to the dryer is performed, so that the user can operate the dryer more conveniently.

Based on the information transmitted from the washing machine to the dryer, an optimal operation condition of the dryer can be selected. After the optimal operation condition of the dryer 20 is confirmed, the user corrects the operation information of the dryer 20. After such a correction is performed, the dryer operates to start the drying of the laundry. At this time, the heater 29, the fan 26 and the motor 28 operate. Based on the inner information of the dryer inputted from the sensor 27, the drying status of the laundry in the dryer is caught and the operation cycles of the dryer can be adjusted in detail.

Hereinafter, a method for controlling the dryer according to the present invention will be described in detail.

Figure 4:
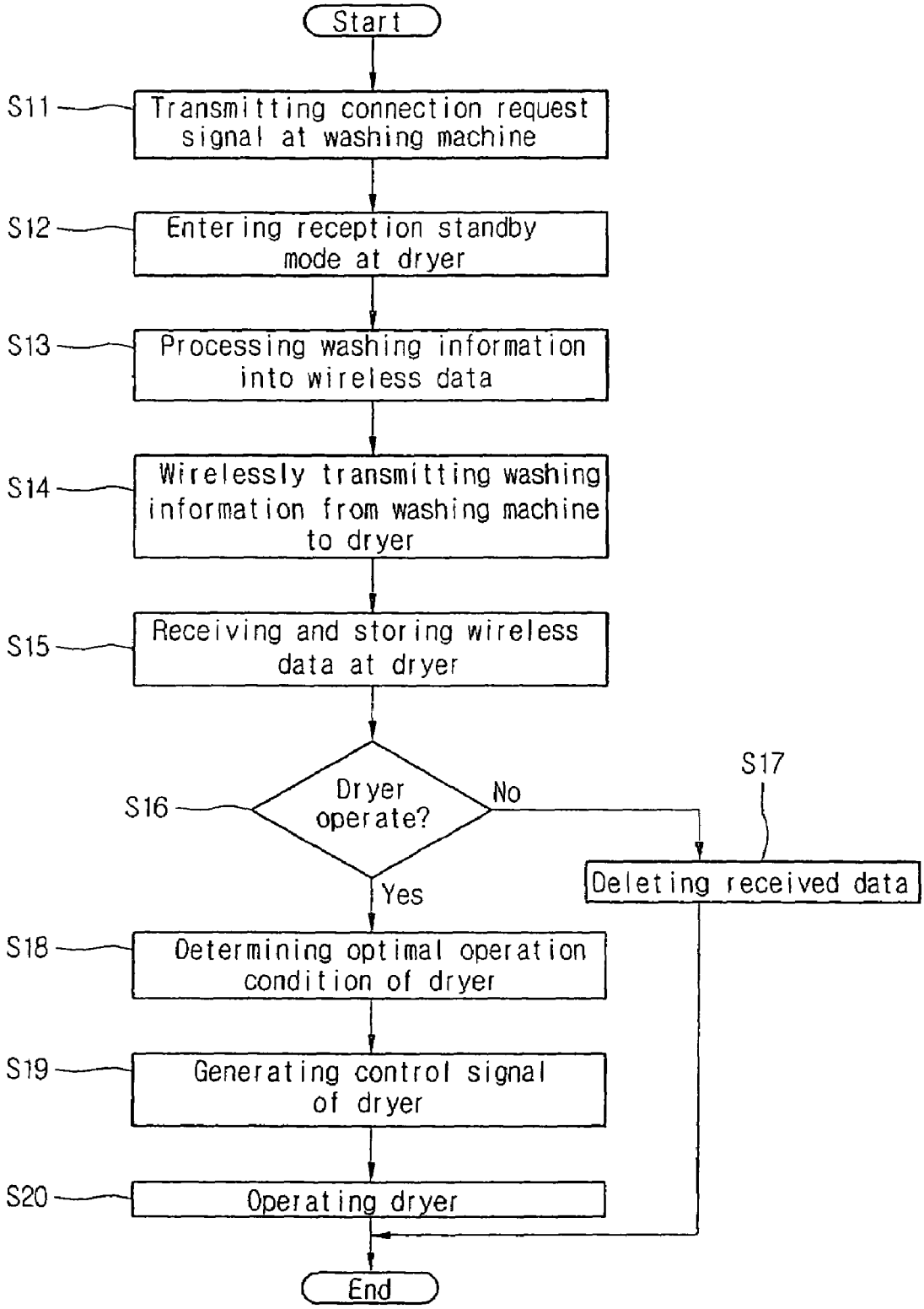
FIG. 4 is a flow diagram illustrating a method for controlling a washing/drying system according to the first embodiment of the present invention.

FIG. 4 is a flow diagram illustrating a method for controlling a washing/drying system according to the first embodiment of the present invention. In FIG. 4, it is assumed that all cycles of the washing operation have been completed.

Referring to FIG. 4, when all cycles of the washing operation are completed in the washing machine 10, the washing machine 10 wirelessly transmits a connection request signal to the dryer 20. (S11) After receiving the connection request signal, the dryer 20 enters a reception standby mode and transmits a signal informing that the dyer 20 is in the standby mode to the washing machine 10. (S12) Thereafter, the washing machine processes the information sensed during the washing operation of the washing machine or the information known by the user's input to generate a wireless data. (S13) Then, the washing machine 10 wirelessly transmits the generated wireless data to the dryer 20. (S14) Specifically, the wireless data obtained by processing the information stored in the memory 15 at the wireless washing machine communication part 19 is transmitted through the antenna 12.

At the dryer 20, the antenna 22 receives the information wirelessly transmitted from the washing machine, and the wireless dryer communication part 30 processes the received information to convert the received information into information usable in the dryer 20. The converted information is stored in the memory 25 of the dryer 20 and can be used for the operation of the dryer 20 later. (S15)

The above operations S11 through S15 can be performed whenever after all information necessary for the operation of the washing machine is stored and before the operation of the dryer starts. In detail, the above operations S11 through S15 can be performed when the washing cycles of the washing machine 10 are completed, when a door of the washing machine is opened, or when the washed laundry is loaded into the dryer.

Through the above operations, if the information used during the operation of the washing machine is wirelessly transmitted to the dryer 20, the dryer 20 is operatable and enters the operation standby mode. As the user starts the operation of the dryer 20 (S16), the information stored in the memory 25 is processed and the operation of the dryer 20 starts. However, if the operation of the dryer 20 does not start even after elapse of a predetermined time, it is determined that the laundry is not loaded into the dryer 20 but is naturally dried or only the operation of the washing machine is performed. Therefore, the information stored in the dryer memory 25 is deleted and all control methods are ended. (S17)

In the meanwhile, if the operation of the dryer starts after the elapse of a predetermined time, an optimal operation condition suitable for the operation of the dryer 20 is determined based on the information stored in the dryer memory 25. (S18) The optimal operation condition includes the information related with the kinds of laundries, the information related with the supply amount of detergent, the information related with the operation time of the washing machine and the information related with the amount of laundry, which are wirelessly transmitted to the dryer 20 from the washing machine 10.

If the optimal operation condition of the dryer 20 is determined, a control signal for operating each load of the dryer 20 is generated (S19) and the operation of the dryer 20 is performed. (S20)

Meanwhile, prior to initiating the operation of the dryer 20, the user may observe the optimal operation condition automatically determined to correct the optimal operation condition through the dryer manipulator 21.

According to the proposed method for controlling the dryer, since the washing information of the washing machine can be conveniently transferred to the dryer, user convenience can be further enhanced.

Second Embodiment

The second embodiment according to the spirit of the present invention is the same in many parts as the first embodiment but has a main difference in that the position of the dryer manipulator is varied. Accordingly, sufficient description can be understood with reference to the description disclosed in the first embodiment.

Figure 5:
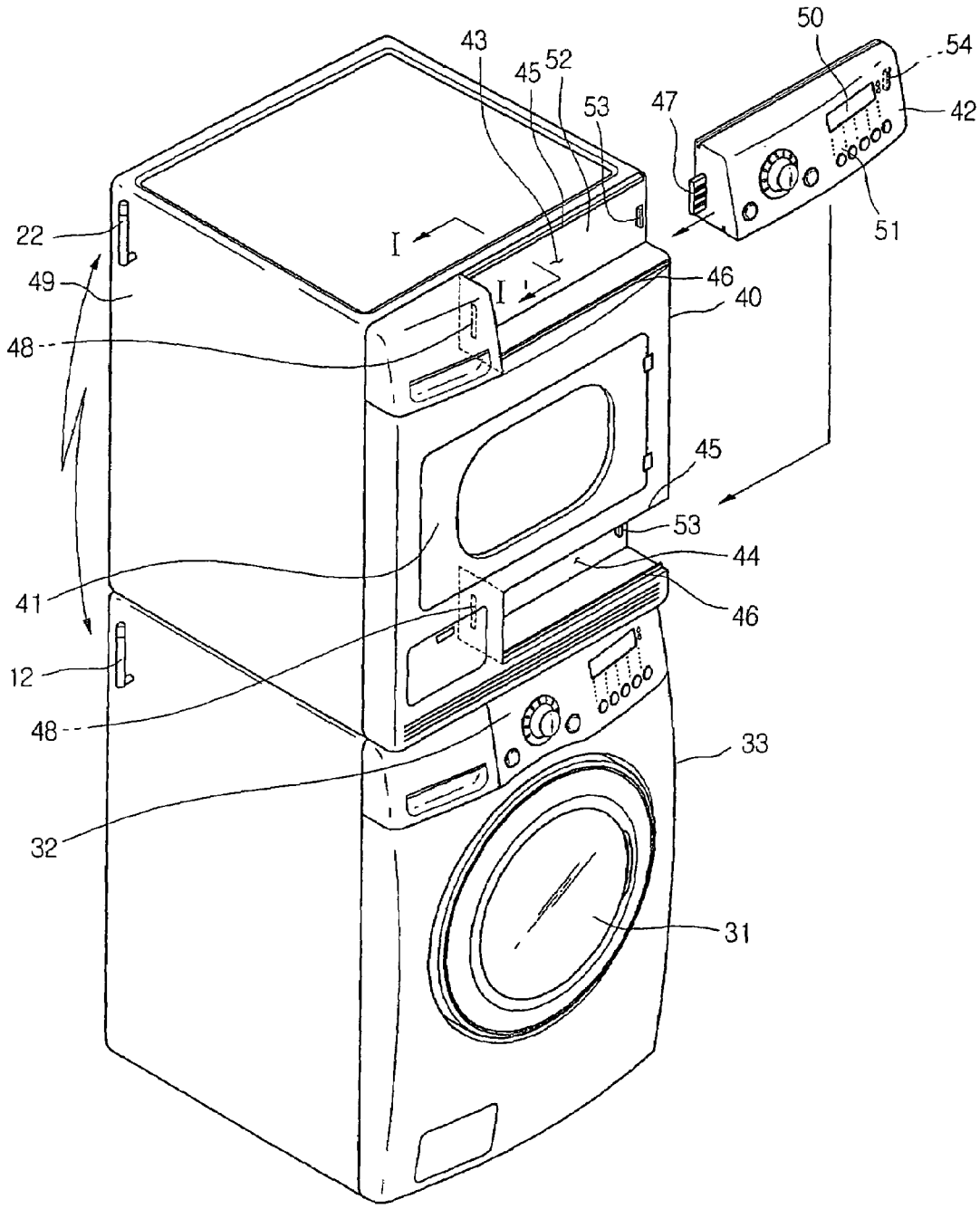
FIG. 5 is a perspective view illustrating use of a washing/drying system according to a second embodiment of the present invention.

FIG. 5 is a perspective view illustrating use of a washing/drying system according to a second embodiment of the present invention.

Referring to FIG. 5, a dryer 40 is disposed on a washing machine 33. Since the washing machine 33 has a washing machine antenna 12 and the dryer 40 has a dryer antenna 42, a wireless communication can be performed between the washing machine 33 and the dyer 40.

In detail, the washing machine 33 includes a door 31 formed at a front side of the washing machine 33, through which laundry is loaded, and a washing machine manipulator 32 formed at a front upper side of the washing machine 33, for controlling operation of the washing machine at a user. Meanwhile, the dryer 40 includes a case 49 forming the exterior of the dryer 40, a door 41 used for loading washed laundry, and a dryer manipulator 42 for manipulating the dryer 40. The position of the dryer manipulator 42 may be changed to another position. Although FIG. 5 does not show a drum, a motor and the like that are essential elements for the washing machine 33 and the dryer 40, it is natural that such elements are equipped in the insides of the washing machine 33 and the dryer 40.

In detail, the dryer manipulator 42 may be selectively mounted on a first receiving part 43 formed at an upper side of the dryer 40 or on a second receiving part 44 formed at a lower side of the dryer 40. The dryer manipulator 42 is made in the form of a separatable structure such that the dryer manipulator 42 is selectively mounted on any of the first receiving part 43 and the second receiving part 44.

Also, the dryer 40 includes a display part 50 formed at a predetermined portion of a front side of the dryer 40 such that the user observes the operation of the dryer 40, a manipulation button part 51 used for performing a control operation of the dryer 40, and a second connection terminal 47 formed at a predetermined portion of the dryer manipulator 42 for an electrical signal transmission between a main body of the dryer 40 and the dryer manipulator 42.

In addition, each of the first receiving part 43 and the second receiving part 44 includes a first connection terminal 48 connected with the second connection terminal 47 to electrically connect the main body of the dryer 40 with the dryer manipulator 42 each other such that a predetermined signal communicates between the main body of the dryer 40 and the dryer manipulator 42, and first and second guide ribs 45 and 46 for fixing the position of the dryer manipulator 42 inserted into and mounted on the first receiving part 43 or the second receiving part 44. Each of the first receiving part 43 and the second receiving part 44 further includes a latch such that the dryer manipulator 42 inserted into the first receiving part 43 or the second receiving part 44 is not released from the first receiving part 43 or the second receiving part 44.

The latch includes a second latch 54 formed at a predetermined portion of the dryer manipulator 42, and a first latch 53 formed at a predetermined portion of an inside of the first receiving part 43 or the second receiving part 44 and latched with the first latch 54. The first and second latches 53 and 54 are formed at positions corresponding to each other such that the dryer manipulator 42 is completely inserted into and coupled with the first receiving part 43 or the second receiving part 44.

Also, the first and second guide ribs 45 and 46 are formed at the front surface of the first receiving part 43 and the second receiving part 44 such that the dryer manipulator 42 is received in and is not released from the first receiving part 43 or the second receiving part 44.

Operation of the washing/drying system proposed in the second embodiment of the present invention will now be described with reference to the accompanying drawing.

As shown in FIG. 5, when the washing machine and the dryer are disposed in the stack structure, the dryer manipulator 42 is inserted into and mounted in the inside of the second receiving part 44 formed at the lower side of the dryer 40. Accordingly, the user can manipulate the dryer using the dryer manipulator 42 which is leveled at a similar height to the washing machine manipulator 32 and does not feel inconvenience due to the height of the dryer manipulator 42. In addition, when the washing machine and the dryer are disposed in parallel in a horizontal direction, the dryer manipulator 42 is inserted into and mounted in the first receiving part 43. At this time, since the dryer manipulator 42 is positioned at a proper height, the user can operate the dryer conveniently.

The second connection terminal 47 is formed at the predetermined portion of the dryer manipulator 42 and the first connection terminal 48 is formed at the inside of the first receiving part 43 or the second receiving part 44 such that the first connection terminal 48 is connected with the second connection terminal 47 after the dryer manipulator 42 is mounted in the first receiving part 43 or the second receiving part 44.

The second connection terminal 47 and the first connection terminal 48 are aligned in series after the dryer manipulator 42 is completely mounted in the inside of the first receiving part 43 or the second receiving part 44. By doing so, a signal of the dryer manipulator 42 is normally transmitted to the main body of the dryer 40, so that the operation of the dryer can be performed. Also, after the dryer manipulator 42 is mounted in the inside of the first receiving part 43 or the second receiving part 44, the second latch 54 of the dryer manipulator 42 is latched with the first latch 53. Accordingly, the dryer manipulator 42 is not released from the first receiving part 43 or the second receiving part 44 if a power exceeding a critical pulling force is not applied.

Thus, since the dryer manipulator 42 can be variably disposed at any of the upper side and the lower side of the dryer 40, the user can handle the dryer manipulator 42 easily and manipulate the dryer conveniently even though the dryer is disposed in the stack structure or in the parallel structure. Alternatively, the dryer manipulator may be formed at both of the lower side and the upper side of the dryer.

In particular, the present embodiment can be conveniently applied to the stack structure of the washing machine and dryer irregardless of whether information is wirelessly transmitted from the washing machine to the dryer. However, the dryer can be used more conveniently when the information of the washing machine is wirelessly transmitted to the dryer.

Figure 6:
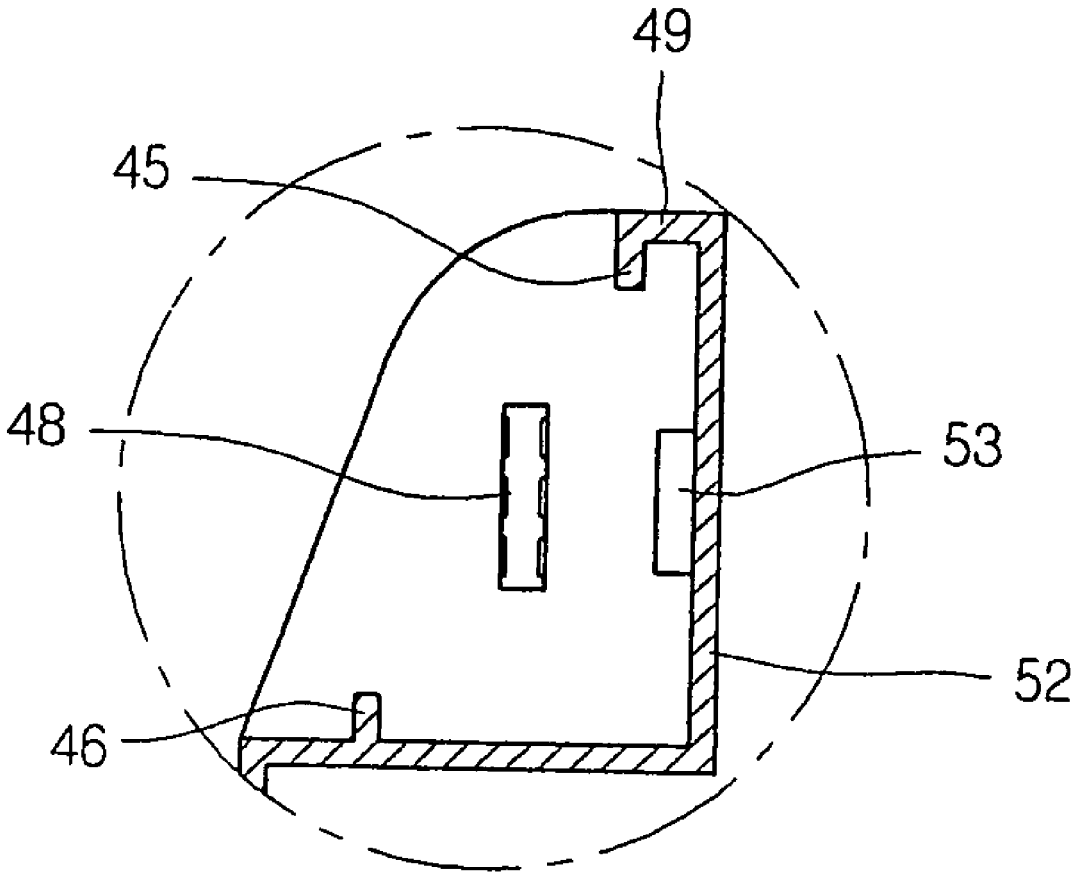
FIG. 6 is a sectional view taken along the line I-I' of FIG. 5.

FIG. 6 is a sectional view taken along the line I-I' of FIG. 5.

Referring to FIG. 6, the dryer 40 includes an inner case 52 concavely formed inside the case 49, a first latch 53 protrudedly formed from an outer surface of the inner case 52, the first connection terminal 48 formed inside the first receiving part 43 and aligned with the second connection terminal 47, and the first and second guide ribs 45 and 46 enabling a user to observe the dryer manipulator 42 from an outside.

According to the above embodiment, since the dryer manipulator can be conveniently mounted at the upper side or the lower side of the dryer, when the washing/drying system is disposed in the stack structure, it can be apparently understood that the washing/drying system can be more conveniently used.

Third Embodiment

The third embodiment according to the spirit of the present invention is the same in many parts as the first embodiment but has a main difference in that a user can directly manipulate a dryer using a washing machine.

Accordingly, insufficient description can be understood with reference to the description disclosed in the first embodiment.

Figure 7:
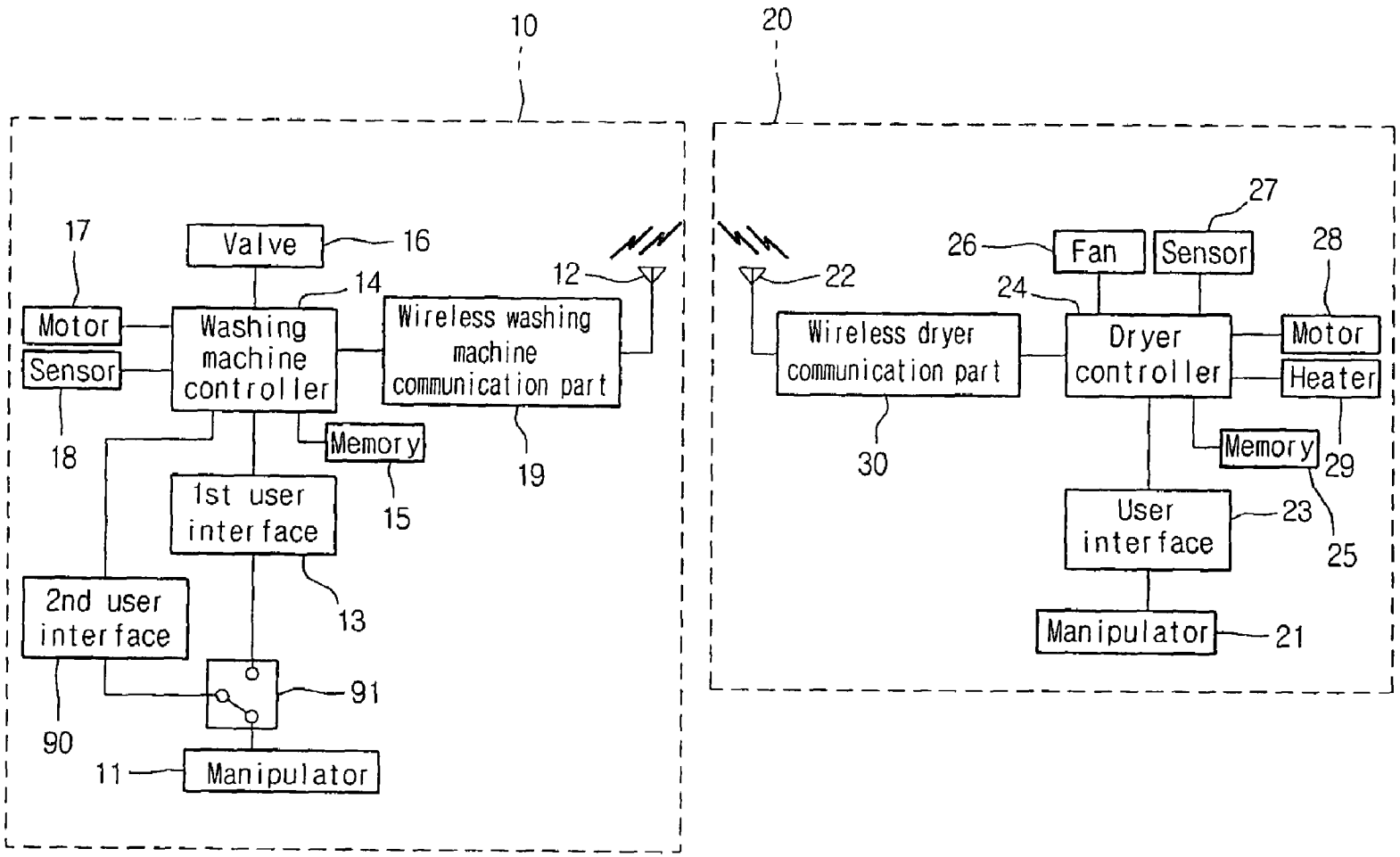
FIG. 7 is a block diagram of an apparatus for controlling a washing/drying system according to a third embodiment of the present invention.

FIG. 7 is a block diagram of an apparatus for controlling a washing/drying system according to a third embodiment of the present invention.

Referring to FIG. 7, the washing machine 10 includes a washing machine manipulator 11 for inputting a manipulation signal to the washing machine 10 at a user, first and second user interfaces 13 and 90 for determining the manipulation signal inputted through the washing machine manipulator 11, a washing machine controller 14 for determining the manipulation signals inputted through the user interfaces 13 and 90 to control the washing machine 10 such that the washing machine 10 operates in a proper condition, and a switch 91 for selectively inputting the manipulation signal inputted through the manipulator 11 into the first user interface 13 or the second user interface 90. For instance, the first user interface 13 can be used as the interface for the operation of the washing machine, and the second user interface 90 can be used as the interface for the operation of the dryer.

Meanwhile, since the dryer has the same elements as those in the first embodiment, their description can quote from that of the first embodiment.

Hereinafter, the operation of the apparatus for controlling the washing/drying system will be described.

When the user intends to use the washing machine, laundry is loaded into the inside of the washing machine and the user inputs known facts related with the laundry. The input information can include various types, for example, information related with the kinds of laundry (nylon, cotton, wool and the like), information regarding supply amount of detergent, and information related with operation time of the washing machine. The informations can be inputted by the user's determination.

The information inputted by the user is used to operate the washing machine as soon as the user operates the washing machine. As the washing machine operates, the washing machine can sense information related the laundry during an initial operation, for example, weight, volume and the like of the laundry, and the sensed information can be also used for the operation of the washing machine. When the user inputs information for the operation of the washing machine through the manipulator 11, the switch 91 makes the manipulator 11 and the first user interface 13 connected with each other.

Base on the information related with the kinds of laundry, the information related with supply amount of detergent, and the information related with operation time of the washing machine, the washing machine performs washing, rinsing and dewatering cycles. As the operation of the washing machine is ended, the user loads the washed laundry into the dryer 20 and operates the dryer 20. Before the laundry is loaded into the dryer and the dryer operates, the step of wirelessly transmitting the information stored in the washing machine to the dryer is performed, so that the user can operate the dryer more conveniently.

The user can input control information for controlling the dryer through the washing machine manipulator 11 and the control information can be stored in a memory 15. At this time, the switch 91 connects the manipulator 11 with the second user interface 90. For this operation, the switch 91 is formed at a predetermined position of the washing machine.

Further, the information wirelessly transmitted from the washing machine to the dryer may include information known during the operation of the washing machine as well as the control information of the dryer inputted by the user.

According to the above embodiment, it becomes possible for the user to directly control the dryer through the washing machine without varying the position of the manipulator 42 like in the second embodiment.

Fourth Embodiment

The fourth embodiment according to the spirit of the present invention is the same in many parts as the first embodiment but has a main difference in that operation of a dryer is monitored and controlled by a remote controller. Accordingly, insufficient description can be understood with reference to the description disclosed in the first embodiment.

Figure 8:
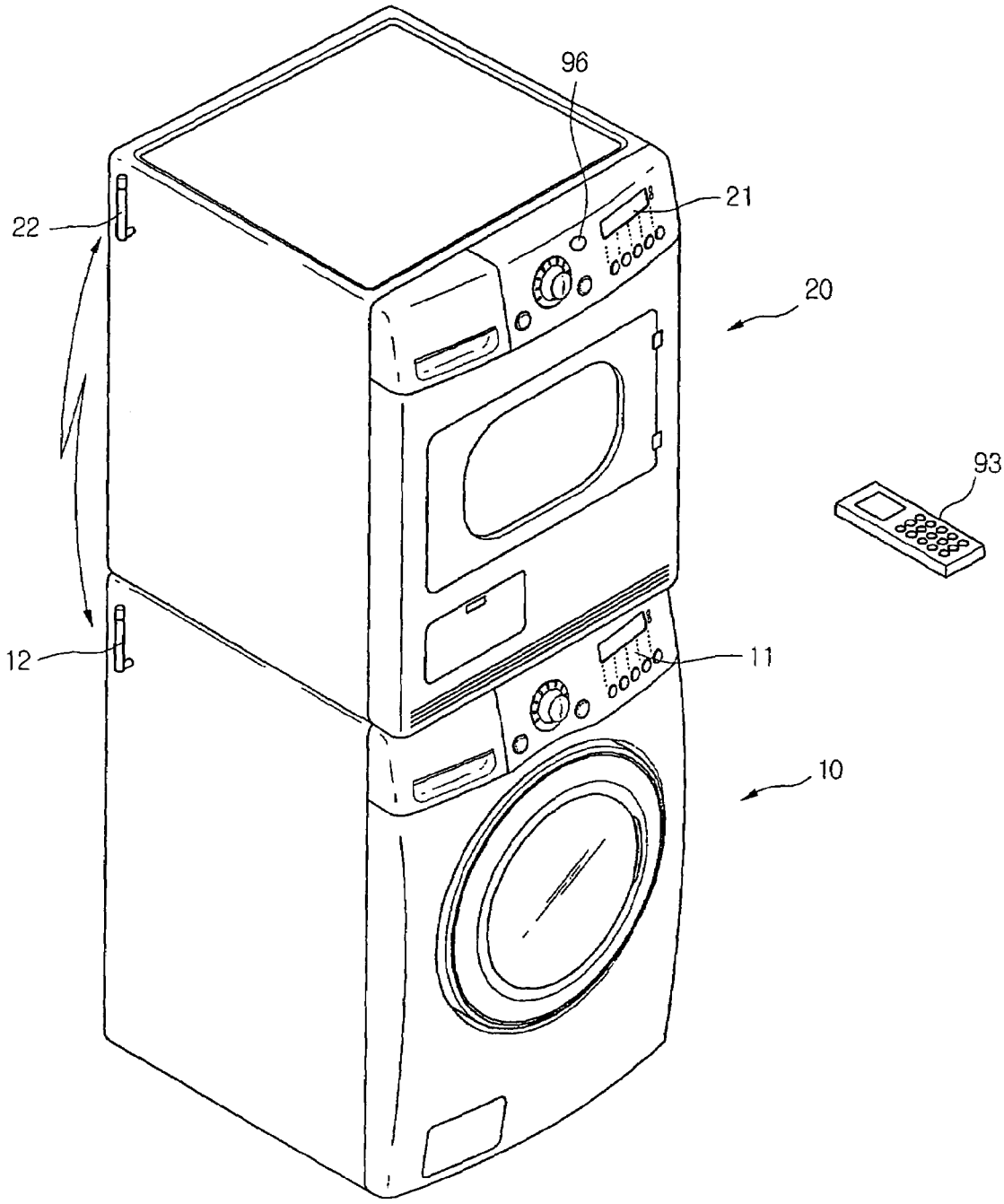
FIG. 8 is a perspective view illustrating use of a washing/drying system according to a fourth embodiment of the present invention.

FIG. 8 is a perspective view illustrating use of a washing/drying system according to a fourth embodiment of the present invention.

Referring to FIG. 8, the dryer 20 is disposed on the washing machine 10. The washing/drying system includes a washing machine manipulator 11 formed at a front upper side of the washing machine 10, for instructing kinds of laundries, washing methods and the like at the user, and a dryer manipulator 21 formed at a front upper side of the dryer 20 and manipulated by the user.

Also, the washing/drying system includes a dryer antenna 22 formed at a predetermined portion of the dryer 20, and a washing machine antenna 12 formed at a predetermined portion of the washing machine 10. The washing machine antenna 12 wirelessly communicates with the dryer antenna 22 such that information obtained during the operation of the washing machine is transmitted to the dryer 20. All kinds of communication regulations including an infrared communication regulation, a supersonic communication regulation, a radio frequency (RF) communication regulation, and a Bluetooth communication regulation can be allowed for wireless communication between the washing machine antenna 12 and the dryer antenna 22.

The washing/drying system further includes a remote controller 93 for displaying operation status of the dryer 20 and manipulating the operation status of the dryer 20 at the user, and a remote controller transmitting/receiving part 96 formed at a predetermined portion of the dryer 20, for receiving information inputted by the remote controller 93 and transmitting the operation status of the dryer 20 to the remote controller 93.

Figure 9:
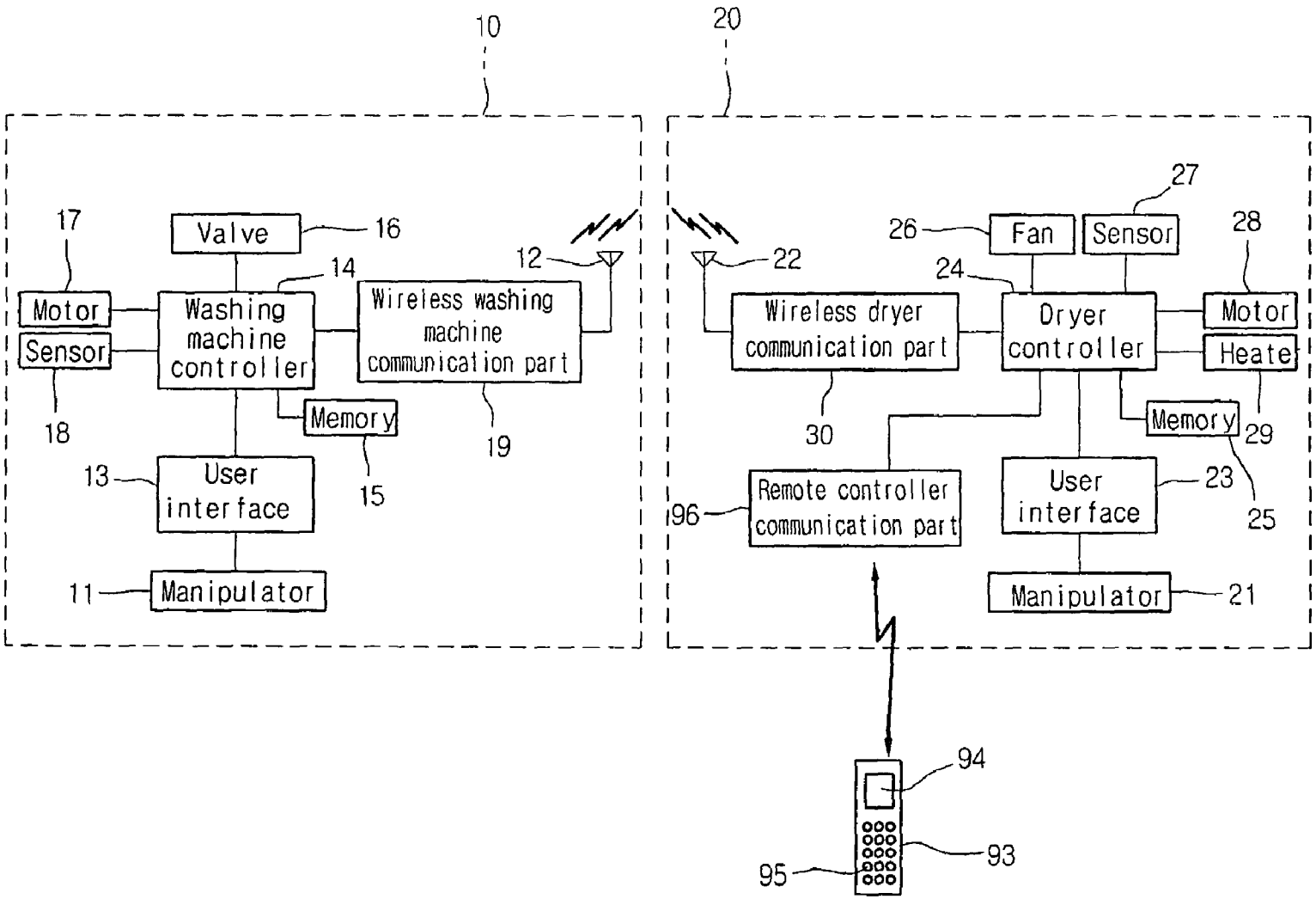
FIG. 9 is a block diagram of an apparatus for controlling a washing/drying system according to the fourth embodiment of the present invention.

FIG. 9 is a block diagram of an apparatus for controlling a washing/drying system according to the fourth embodiment of the present invention.

Referring to FIG. 9, the washing machine 10 has the same elements as those in the first embodiment.

The dryer 20 includes a dryer antenna 22 for wirelessly receiving information wirelessly transmitted through the washing machine antenna 12, and a wireless dryer communication part 30 through which the information received through the dryer antenna 22 is inputted. In addition, the dryer 20 includes a manipulator 21 for inputting a manipulation signal instructed by the user for the operation of the dryer, a user interface 23 for inputting the manipulation signal of the manipulator 21 to a dryer controller 24, and a memory 25 for storing information related with the operation of the dryer 20.

Further, the dryer 20 includes the remote controller 93 and the remote controller transmitting/receiving part 96 for receiving information inputted by the remote controller 93 and transmitting the operation status of the dryer 20 to the remote controller 93. The remote controller 93 includes a remote controller manipulator 95 having a plurality of buttons for manipulating the operation status of the dryer 20 at the user, and a display part 94 for observing the current operation status of the dryer 20 and the operation status of the dryer 20 manipulated by the user.

The operation of the apparatus for controlling the washing/drying system will be described in brief.

Information known during the operation of the washing machine and information inputted by the user are stored in the memory 15, are then inputted into the dryer 20 through the wireless washing machine communication part 12 and the wireless dryer communication part 22, and are then temporarily stored in the memory 25 of the dryer 20.

Information for controlling the washing machine 10 is transmitted to the remote controller 93 via the remote controller communication part 96 and is then displayed on the display part 94. The user watches the control information of the remote controller displayed on the display part 94 and then manipulates the dryer 20. In detail, according to the control information of the washing machine 10, the dryer controller 24 can determine and transmit an optimal operation condition of the dryer. Alternatively, after confirming the transmitted optimal operation condition, the user may correct and select the optimal operation condition and operate the dryer 20.

Hereinafter, the method for controlling the washing/drying system according to the present embodiment will be described in detail.

Figure 10:
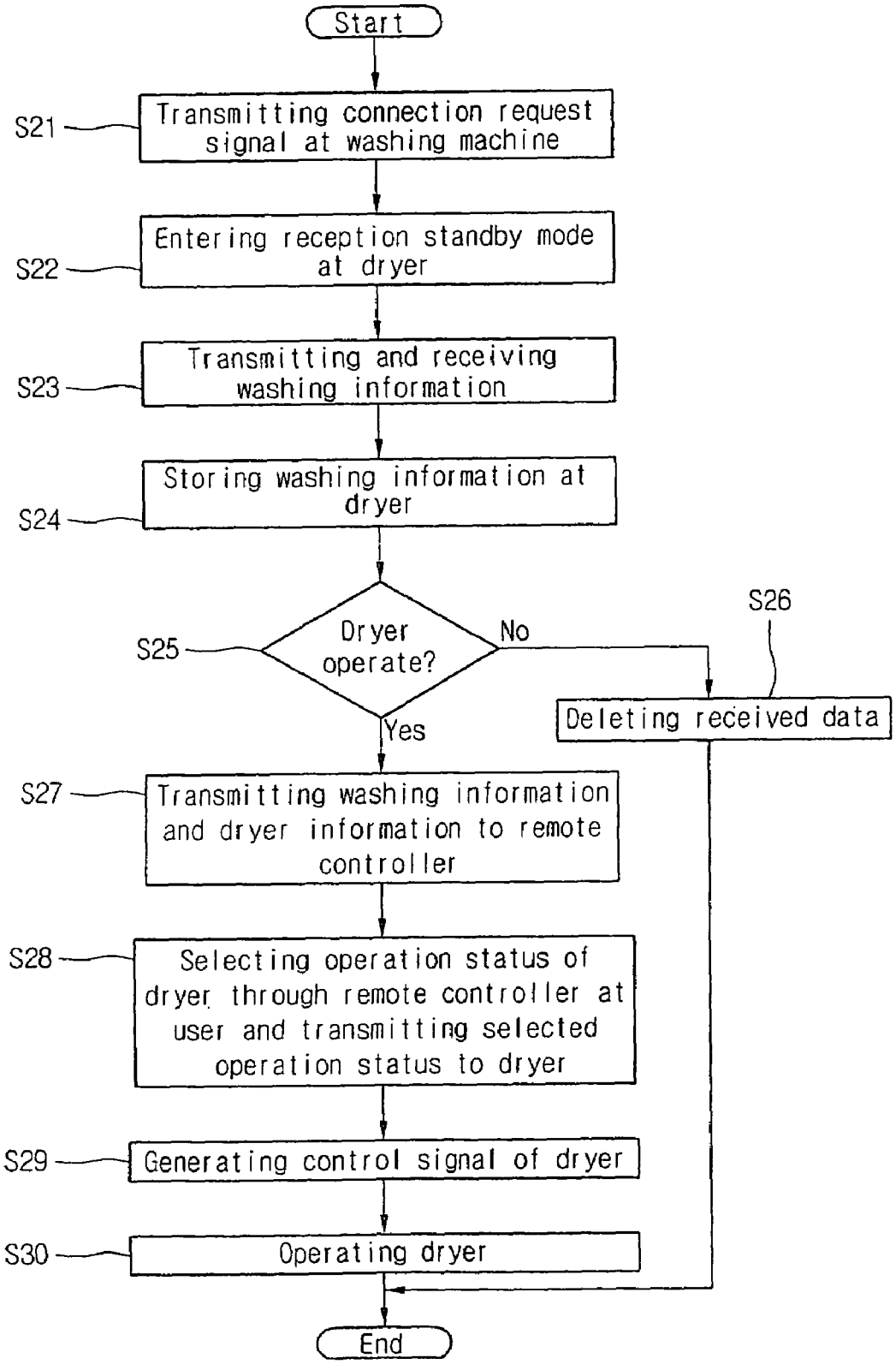
FIG. 10 is a flow diagram illustrating a method for controlling a washing/drying system according to the fourth embodiment of the present invention.

FIG. 10 is a flow diagram illustrating a method for controlling a washing/drying system according to the fourth embodiment of the present invention. In FIG. 10, it is assumed that all cycles of the washing operation have been completed.

Referring to FIG. 10, when all cycles of the washing operation are completed in the washing machine 10, washing-related information is stored and the washing machine 10 wirelessly transmits a connection request signal to the dryer 20. (S21) After receiving the connection request signal, the dryer 20 enters a reception standby mode and informs the washing machine 10 of such a fact that the dyer 20 is in the standby mode. (S22)

Thereafter, the washing machine processes the information sensed during the washing operation of the washing machine, and then wirelessly transmits the processed information to the dryer 20. (S23) The dryer 20 receives the information wirelessly transmitted from the washing machine and stores the received information in the memory 25 of the dryer 20, which will be used for the operation of the dryer 20. (S24)

As the user starts the operation of the dryer 20 (S25), the information stored in the memory 25 is processed and the operation of the dryer 20 starts. However, if the operation of the dryer 20 does not start even after elapse of a predetermined time, it is determined that the laundry is not loaded into the dryer 20 but is naturally dried or only the operation of the washing machine is performed. Therefore, the information stored in the dryer memory 25 is deleted and all control methods are ended. (S26)

In the meanwhile, if the operation of the dryer starts before the elapse of a predetermined time, the control information of the washing machine stored in the dryer memory 25 is transmitted to the remote controller. (S27) In the step S27, the dryer controller 24 may determine and transmit the optimal operation condition of the dryer to the remote controller 93 based on the specification of the dryer and the control information of the washing machine.

After viewing the information displayed on the display part of the remote controller, the user selects and determines the operation status of the dryer and operates the dryer. (S28) After that, the remote controller generates a control signal for driving each of the elements of the dryer and deletes the control information of the washing machine stored in the remote controller. (S29) Thereafter, the step of initiating the operation of the dryer is performed. (S30)

According to the proposed control method, it is possible to operate the washing/drying system more conveniently. Also, according to the present embodiment, since the operation information of the dryer can be monitored more conveniently, the optimal operation status can be determined and conveniently transmitted to the dryer, user convenience can be further enhanced.

Fifth Embodiment

The fifth embodiment according to the spirit of the present invention is the same in many parts as the fourth embodiment but has a main difference and improvement in a mount structure of a remote controller. Accordingly, insufficient description can be understood with reference to the description disclosed in the fourth embodiment.

Figure 11:
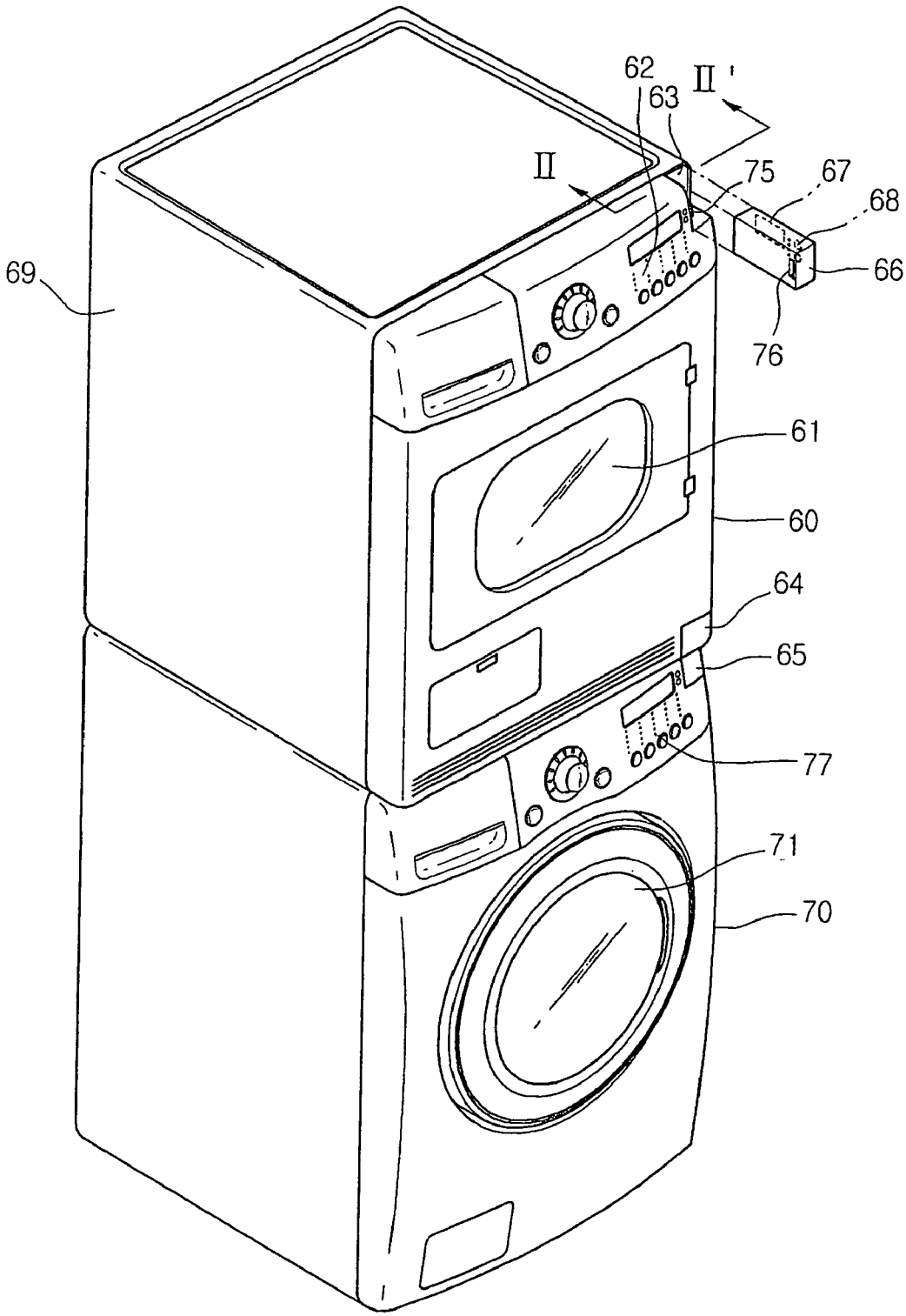
FIG. 11 is a perspective view of a washing/drying system according to a fifth embodiment of the present invention.
Figure 12:
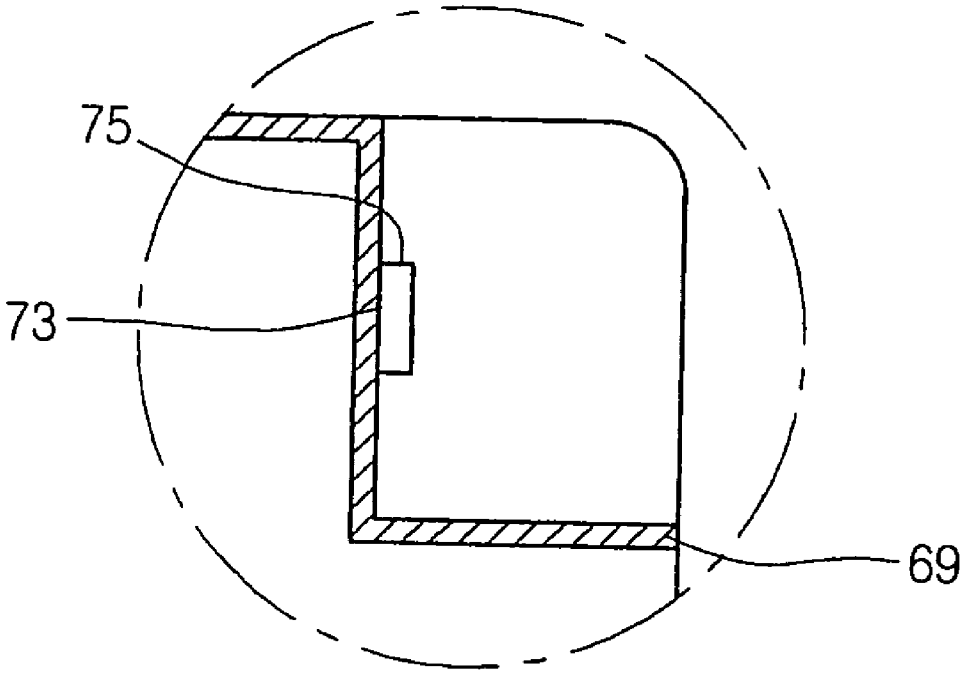
FIG. 12 is a sectional view taken along the line II-II' of FIG. 11.

FIG. 11 is a perspective view of a washing/drying system according to a fifth embodiment of the present invention and FIG. 12 is a sectional view taken along the line II-II' of FIG. 11.

Referring to FIGS. 11 and 12, the washing/drying system of the present embodiment a dryer 60 and a washing machine 70. The dryer 60 and the washing machine 70 have a dryer manipulator 62 and a washing machine manipulator 77 formed at an upper side thereof such that they can be used in a stack structure or in a parallel structure. Also, the washing/drying system includes a remote controller 66 for wirelessly controlling the dryer 60 as a separate element.

In addition to the elements of the fourth embodiment, the dryer 60 includes third and fourth receiving parts 63 and 64 concavely formed from an outer surface of a case 69 such that the remote controller 66 is received at an upper side or a lower side of the dryer 60. The washing machine 70 may have a fifth receiving part 65. Also, the remote controller 66 includes a display part 67 enabling an observation of the operation status and a manipulation button part 68 having a plurality of manipulation buttons. The remote controller 66 can communicate with the main body of the dryer 60 using a general wireless communication unit such as an infrared communication.

In addition, the remote controller 66 has a second latch jaw 76 and at the same time each of the receiving parts 63, 64 and 65 has a first latch jaw 75 such that the received remote controller 66 is not released due to an impact. The first latch jaw 75 is latched with the second latch jaw 76 so that the remote controller 66 can be safely received. Meanwhile, since the remote controller 66 can operate wireless, there is no need of connection terminals unlike in the third embodiment.

Since the remote controller 66 can be received in any of the receiving parts 63, 64 and 65, the user can use the remote controller 66 to operate the dryer at a convenient position. Also, since the remote controller 66 is disposed inside an inner case 63 formed inside the dryer or the washing machine, it does not greatly influence the appearance and accordingly user convenience is enhanced.

When the washing machine and the dryer are used in the parallel structure, it is possible to use the dryer manipulator 62 integrally formed with the dryer. Also, when the washing machine and the dryer are used in the stack structure, it is possible to operate the dryer using the separate remote controller 66, which results in the enhancement in user convenience.

In FIG. 11, non-described numeral 71 indicates a washing machine door, and numeral 61 indicates a dryer door. Also, although not shown in FIG. 11, it is natural that the dryer can include a separate reception sensor for the wireless communication between the dryer and the remote controller 66.

According to the proposed embodiment, since the dryer has a remote controller-receiving portion where the remote controller is safely received, it is advantageous that the user can use the remote controller safely.

Sixth Embodiment

The sixth embodiment according to the spirit of the present invention is the same in many parts as the fourth embodiment but has a main difference in that control information of a dryer is transmitted to a washing machine using a remote controller.

Figure 13:
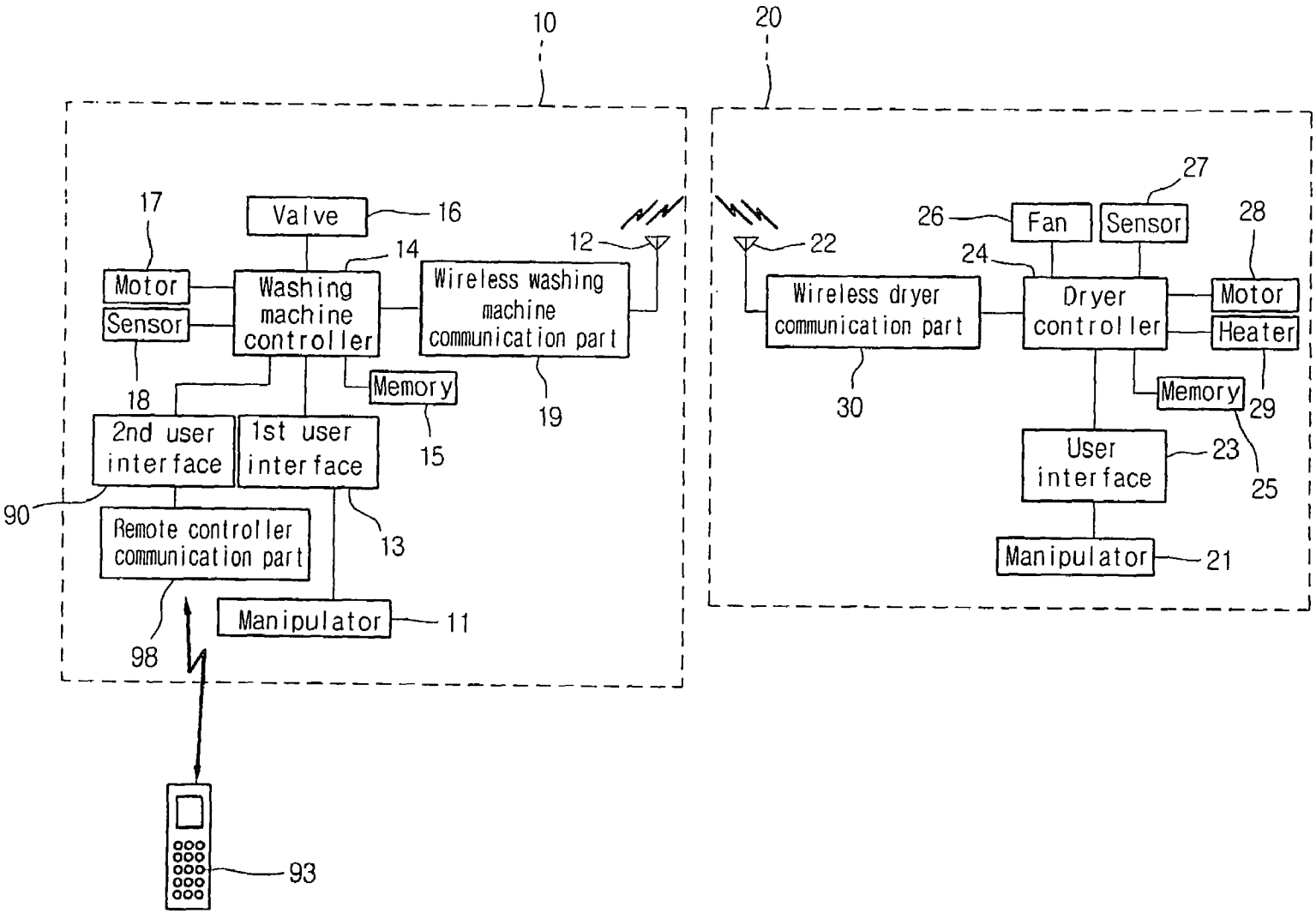
FIG. 13 is a block diagram of an apparatus for controlling a washing/drying system according to a sixth embodiment of the present invention.

FIG. 13 is a block diagram of an apparatus for controlling a washing/drying system according to a sixth embodiment of the present invention.

Referring to FIG. 13, the washing/drying system of the sixth embodiment is the same in many parts as that of the fourth embodiment but has a difference in that it further includes a remote controller communication part 98 connected with a washing machine controller 14, and a remote controller 93 for transmitting control information of a dryer to the remote controller communication part 98 and a second user interface 90. By doing so, the control information of the washing machine can be inputted through a washing machine manipulator 11 and a first user interface 13 and the control information of the dryer can be inputted through the remote controller 93, and vice versa.

Alternatively, it is also possible to transmit the control information of the washing machine and the control information of the dryer to the remote controller communication part 98 using the remote controller 93.

Hereinafter, a method for controlling the washing/drying system will be described in detail.

Figure 14:
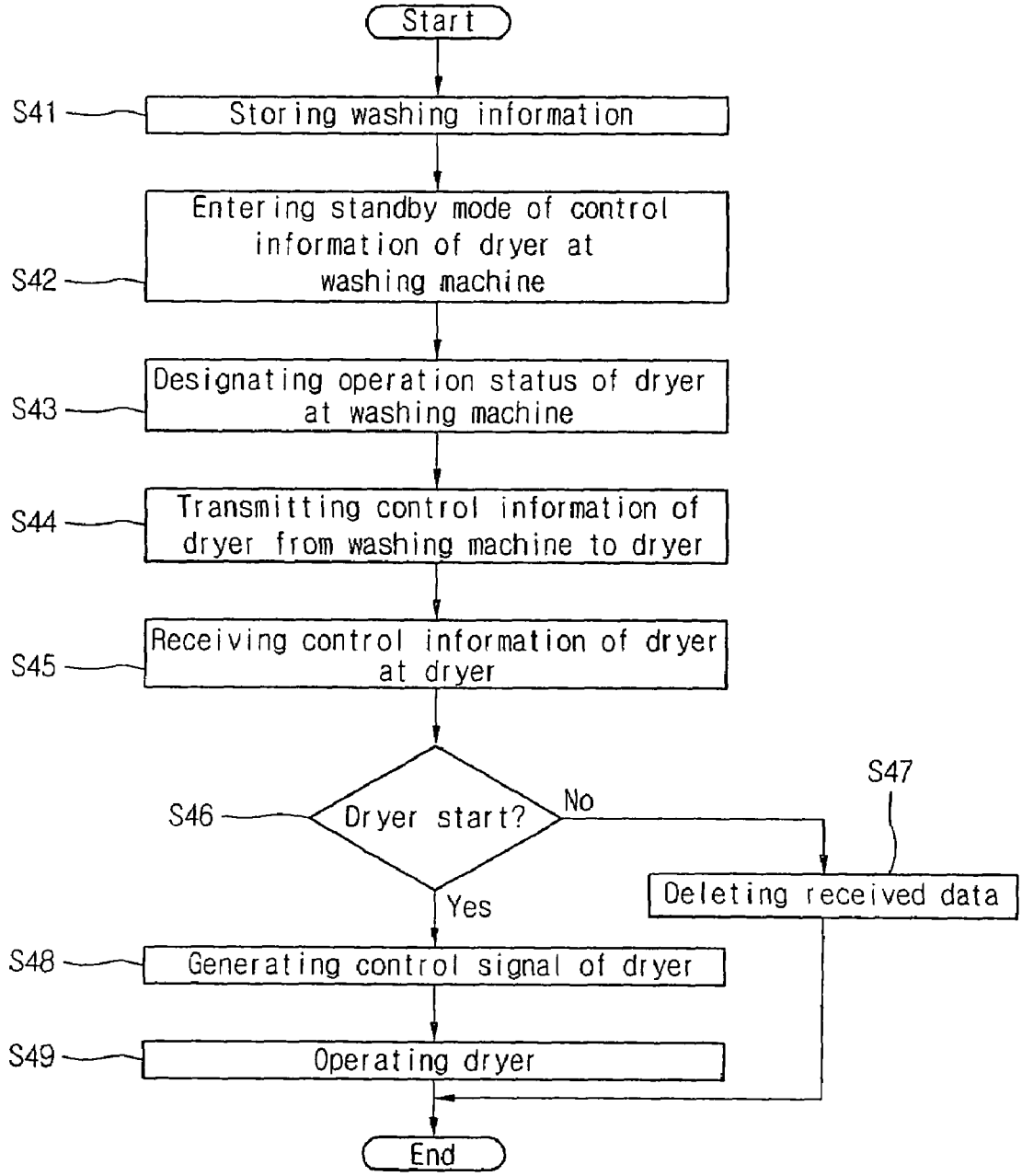
FIG. 14 is a flow diagram illustrating a method for controlling a washing/drying system according to the sixth embodiment of the present invention.

FIG. 14 is a flow diagram illustrating a method for controlling a washing/drying system according to the sixth embodiment of the present invention.

Referring to FIG. 14, when all cycles of the washing operation are completed in the washing machine 10, information related with the washing operation is stored in the washing machine. (S41) The washing machine 10 is in the standby mode such that the control information of the dryer is inputted. (S42) Thereafter, the control information of the dryer is inputted by the remote controller 93. (S43) After that, at the washing machine, information sensed during the washing operation or the control information of the dryer inputted by the user is processed in the format of wireless data and the processed wireless data is wirelessly transmitted from the washing machine to the dryer. (S44) The dryer receives the information transmitted from the washing machine and stores the information, which will be used for the operation of the dryer. (S45)

As the user starts the operation of the dryer 20 (S46), the information stored in the dryer memory 25 is processed and the operation of the dryer 20 starts. However, if the operation of the dryer 20 does not start even after elapse of a predetermined time, it is determined that the laundry is not loaded into the dryer 20 but is naturally dried or only the operation of the washing machine is performed. Therefore, the information stored in the dryer memory 25 is deleted and all control methods are ended. (S47)

In the meanwhile, if the operation of the dryer starts before the elapse of a predetermined time, a control signal for driving each load of the dryer is generated on the basis of the information stored in the dryer memory 25. (S48) After that, the step of initiating the operation of the dryer is performed. (S49)

According to the proposed method for operating the dryer, since the control information of the dryer can be inputted into the washing machine and can be transferred to the dryer, the user can use the dryer disposed on the washing machine in the stack structure more conveniently.

In the meanwhile, when information known during the washing operation is transmitted to the remote controller 93 and the user confirms the known information and corrects the operation information of the dryer, the user can process the operation information of the dryer more conveniently.

Seventh Embodiment

The seventh embodiment according to the spirit of the present invention is the same in use of the remote controller as the fourth embodiment but has a main difference in that washing information is inputted from a washing machine to the remote controller and the operation information of a dryer manipulated by a user is directly transmitted to the dryer. Accordingly, insufficient description can be understood with reference to the description disclosed in the fourth embodiment.

Figure 15:
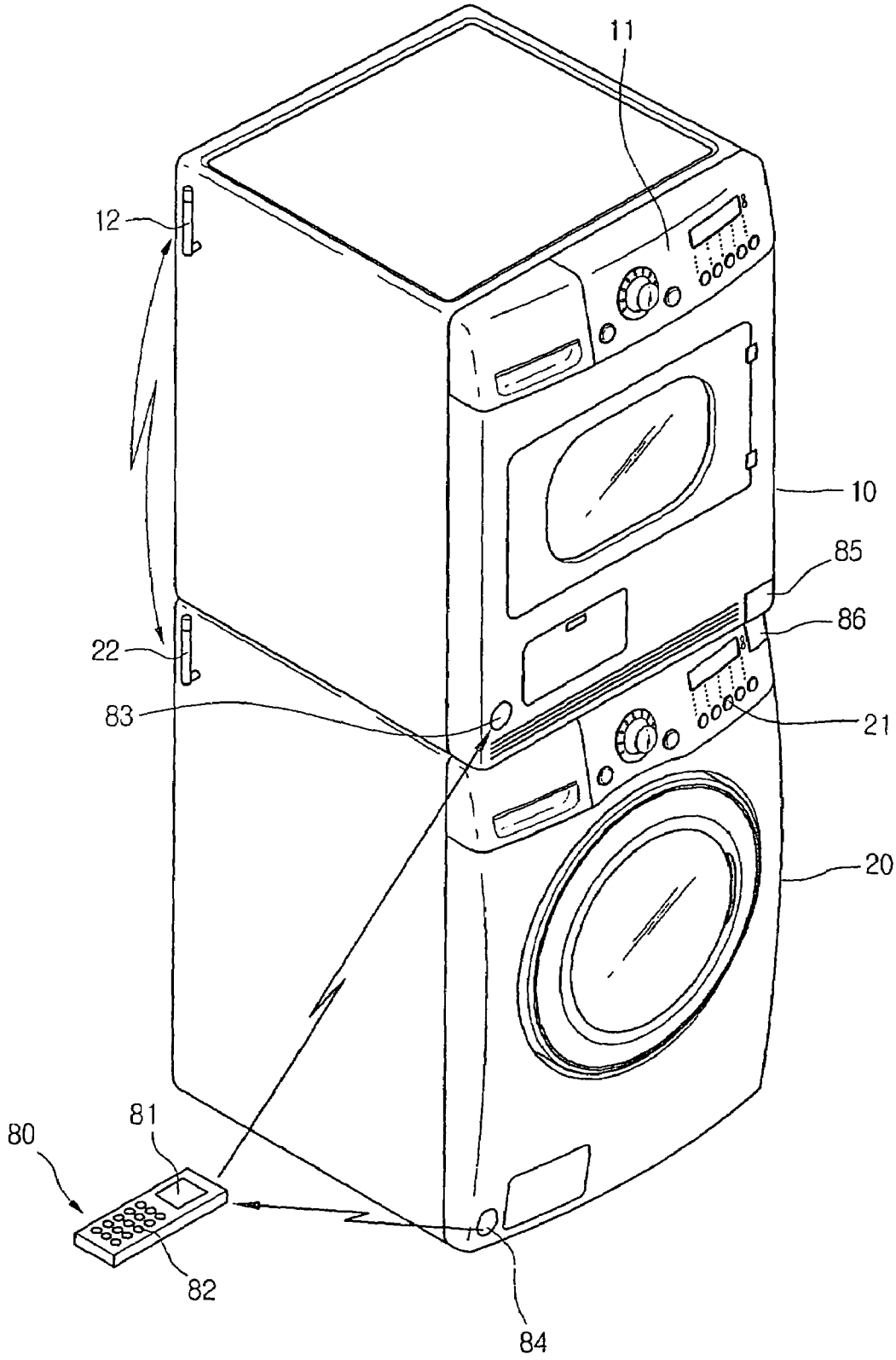
FIG. 15 is a perspective view illustrating use of a washing/drying system according to a seventh embodiment of the present invention.

FIG. 15 is a perspective view illustrating use of a washing/drying system according to a seventh embodiment of the present invention.

Referring to FIG. 15, a dryer 20 is disposed on a washing machine 10. The washing/drying system includes a washing machine manipulator 11 formed at a front upper side of the washing machine 10, for instructing kinds of laundries, washing methods and the like at the user, and a dryer manipulator 21 formed at a front upper side of the dryer 20 and manipulated by the user. The washing machine 10 further includes a remote controller 80 for receiving washing information.

In detail, the remote controller 80 receives control information of the washing machine 10 from a remote controller transmitting part 84 formed at a predetermined portion of the washing machine 10 and transmits control information of the dryer 20 to a remote controller receiving part 83 formed at the dryer 10. For this operation, the remote controller 80 includes a display part 81 enabling an observation of the operation status of the washing machine 20 and the dryer 10 visibly and a manipulation part 82 enabling a user to perform a manipulation. The remote controller 80 also includes therein a microprocessor and a memory for receiving the control information of the washing machine and storing an algorithm to compute an optimal operation condition of the dryer.

Also, the washing/drying system includes a washing machine antenna 12 and a dryer antenna 22 so that the washing machine 10 wirelessly may communicates with the dryer 20. The control information of the washing machine can be transmitted to the dryer 10 through the antennas 12 and 22.

By the above construction, the remote controller 80 receives the control information of the washing machine 10 and searches for an optimal operation condition of the dryer through an algorithm based on the received control information of he washing machine. After confirming the optimal operation condition of the dryer 10, the user performs correction, selection of the optimal operation condition of the dryer 10 and transmits the control information of the dryer 10 to the dryer 10 such that the dryer 10 operates.

The washing machine 20 and the dryer 10 may have a plurality of receiving parts 85 and 86 for receiving the remote controller 80. The remote controller 80 can be received in any of the plurality of receiving parts 85 and 86.

Figure 16:
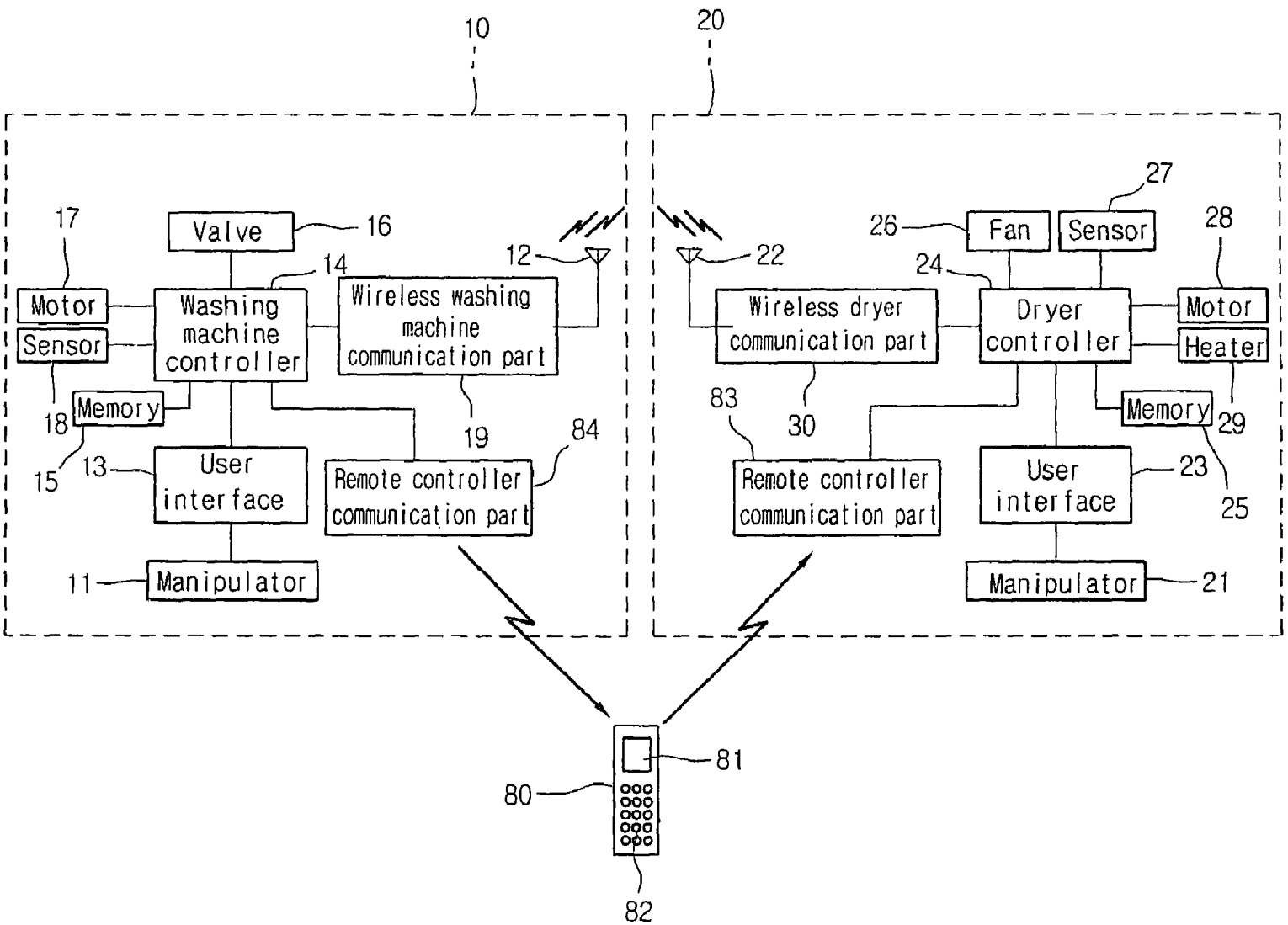
FIG. 16 is a block diagram of an apparatus for controlling a washing/drying system according to the seventh embodiment of the present invention.

FIG. 16 is a block diagram of an apparatus for controlling a washing/drying system according to the seventh embodiment of the present invention.

The washing/drying system shown in FIG. 16 is similar to that of the fourth embodiment but has a difference in that the washing/drying system further includes a remote controller transmitting part 84 included in the washing machine, a remote controller 80 for receiving information transmitted from the remote controller transmitting part 84, and a remote controller receiving part 83 formed in the dryer such that information including user's instruction or selection items is transmitted to the dryer by the remote controller 80. Of course, the information transmitted from the remote controller transmitting part 84 may include various information determined or known during the washing operation.

Hereinafter, a method for controlling the washing/drying system will be described in detail.

Figure 17:
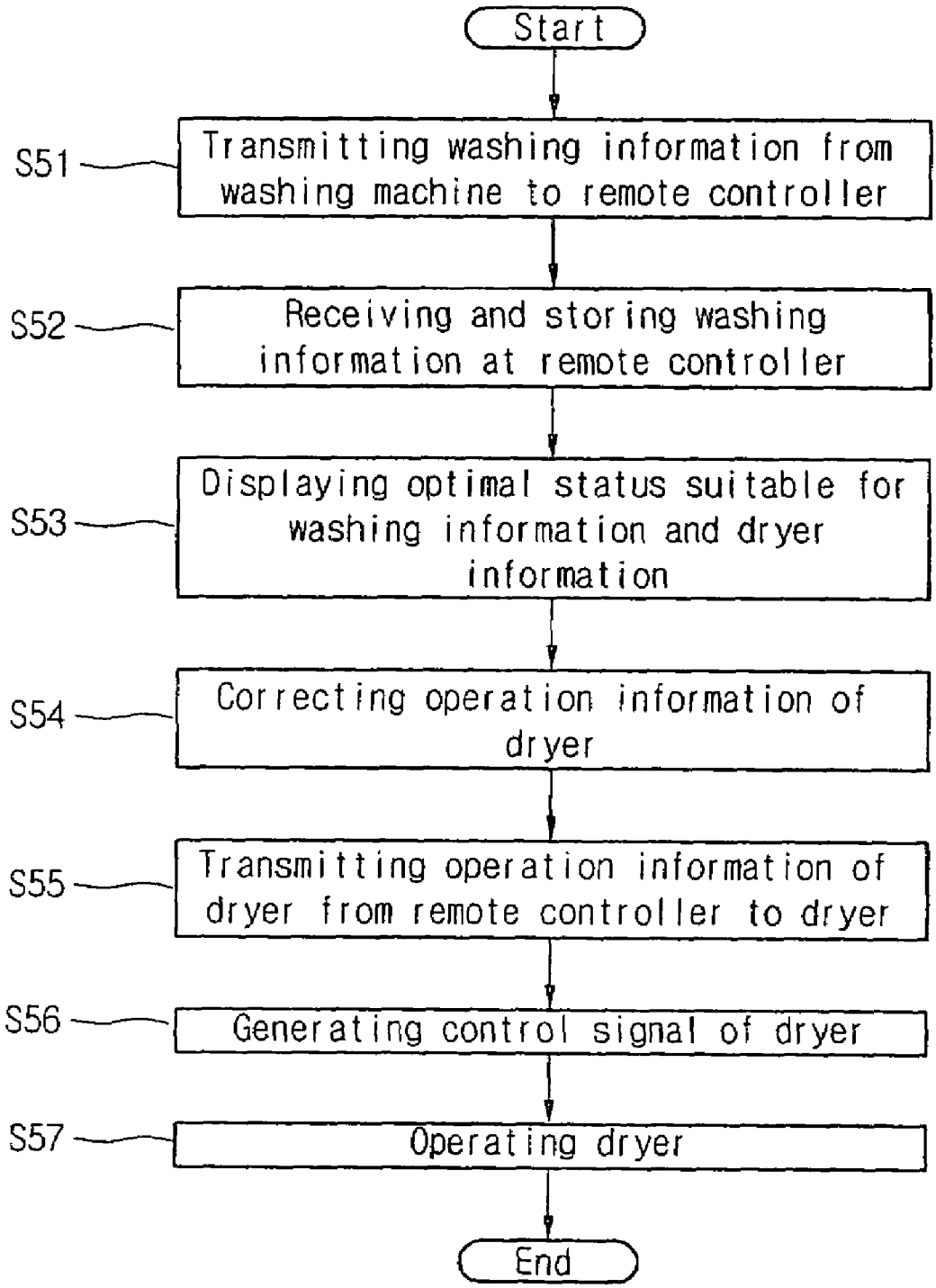
FIG. 17 is a flow diagram illustrating a method for controlling a washing/drying system according to the seventh embodiment of the present invention.

FIG. 17 is a flow diagram illustrating a method for controlling a washing/drying system according to the seventh embodiment of the present invention.

Referring to FIG. 17, when all cycles of the washing operation are completed in the washing machine 10, control information of the washing machine is transmitted from the washing machine to the remote controller. (S51) Then, the remote controller receives the control information of the washing machine and stores it in a memory. (S52)

A microprocessor disposed inside the remote controller searches for an optimal operation condition of the dryer based on the specification of the dryer and the control information of the washing machine and controls the remote controller to display the searched optimal operation condition. (S53) Then, the user corrects the proposed optimal operation condition and inputs operation information of the dryer. (S54) At this time, the user can designate a direct operation time of the dryer, temperature, humidity and the like.

After that, the remote controller transmits the operation information of the dryer to the dryer (S55), generates a control signal of the dryer according to the control information of the dryer, and makes the dryer operate. (S57)

According to the present embodiment, since information related with the operation of the washing machine is safely transmitted to the remote controller, it is advantageous that data reliability is enhanced and the operation status of the dryer is more exactly controlled.

As described above, according to the aforementioned embodiments, a user can control the washing/drying system more conveniently. In particular, when the dryer and the washing machine are used in a stack structure, it is advantageous to manipulate the dryer disposed on the washing machine more conveniently.

Also, since the washing machine and the dryer can be displaced through a simple position change without performing a cable separation procedure, convenient displacement becomes possible.

Further, even when the washing machine and the dryer is disposed in the parallel structure as well as in the stack structure, it is possible to use the washing machine and the dryer conveniently.

Finally, when the washing machine and the dryer are used in one pair, manipulation convenience can be maximized.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for controlling a washing/drying system, the apparatus comprising:

a washing machine which contains control information of at least an operation condition of a dryer;

at least two user interfaces disposed inside the washing machine, for independently processing the control information of the operation condition of the dryer and of an operation condition of the washing machine; and wherein the dryer is disposed independently from the washing machine, and the dryer is adapted for wirelessly receiving control information of the dryer to dry laundry.

2. The apparatus according to claim 1, wherein the washing machine comprises a switch for inputting control information of the washing machine together with the control information or the dryer and selectively processing the control information of the washing machine and the control information of the dryer.

* * * * *